US006938981B2

(12) United States Patent
Yakura et al.

(10) Patent No.: US 6,938,981 B2
(45) **Date of Patent: *Sep. 6, 2005**

(54) IMAGE FORMATION APPARATUS AND CONTROL METHOD THEREOF

(75) Inventors: Yuji Yakura, Kanagawa (JP); Kenji Suzuki, Kanagawa (JP); Hiroshi Tokunaga, Tokyo (JP); Shinichi Horii, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/618,552

(22) Filed: Jul. 11, 2003

(65) Prior Publication Data

US 2004/0130587 A1 Jul. 8, 2004

(30) Foreign Application Priority Data

Jul. 18, 2002 (JP) ..... 2002-210098

(51) Int. Cl.[7] ..... B41J 2/165

(52) U.S. Cl. ..... 347/29; 347/23; 347/30; 347/33; 347/35

(58) Field of Search ..... 347/14, 19, 23, 347/29–35

(56) References Cited

U.S. PATENT DOCUMENTS 4,951,066 A * 8/1990 Terasawa et al. ..... 347/33
4,967,204 A * 10/1990 Terasawa et al. ..... 347/23
5,793,388 A * 8/1998 Martinson et al. ..... 347/19
6,637,856 B2 * 10/2003 Nishi et al. ..... 347/29

* cited by examiner

*Primary Examiner*—Shih-Wen Hsieh
(74) *Attorney, Agent, or Firm*—Robert J. Depke; Trexler, Bushnell, Giangiorgi, Blackstone & Marr

(57) ABSTRACT

An image formation apparatus comprises a cleaning member cylindrically formed of a material having elasticity, a moving mechanism for moving both the peripheral face of the cleaning member and the ink discharge face of the print head relative one to another, with both in contact one with another, and a driving control unit for controlling the driving of the moving mechanism. Each time a predetermined number of sheets of the recording medium have images formed thereupon, or each time a predetermined amount of time elapses, following starting of the operations for forming images, the image formation operations are temporarily interrupted, and the moving mechanism is driven under the control of the driving control unit, and the peripheral face of the cleaning member is moved over the surface of the ink discharge face while in contact therewith, thereby suctioning the ink within the ink discharge orifices.

47 Claims, 17 Drawing Sheets

IMAGE FORMATION APPARATUS AND CONTROL METHOD THEREOF

This application claims priority to Japanese Patent Application Number JP2002-210098 filed Jul. 8, 2002 which is incorporated herein by reference.

BACKGROUND OF THE INVENTION

1. Field of the Invention

The present invention relates to an image formation apparatus which forms images on recording media by discharging ink from ink discharging orifices, and a control method thereof.

2. Description of the Related Art

Ink jet type image formation apparatuses, such as ink jet printers for example, have come into widespread use due to low running costs, the capability to print color images, small apparatus size, and so forth.

Such ink jet printers are arranged to record images by discharging minute amounts of ink from minute ink discharge orifices formed on an ink discharge face of a print head. This arrangement has a problem in that in the event that printing operations have not been performed for a long time, meaning that ink has not been discharged from the ink discharge orifices for a while, the ink adhering near the ink discharge orifices on the discharge face remaining from the previous printing operation may dry due to evaporation, increase in viscosity, and solidify, which makes correct ink discharging difficult.

Conventional arrangements to deal with this problem involve cleaning the print head by pressing a somewhat hard rubber blade against the ink discharge face of the print head, and sliding the blade over the ink discharge face, thereby removing (wiping) the ink which has adhered to the ink discharge face, increased in viscosity, and solidified. Along this line, Japanese Unexamined Patent Application Publication No. 57-34969 discloses a technique for attaching multiple blades to a rotating axis which is rotated, thereby further increasing the wiping effects.

However, such conventional art wipes the ink adhering to the ink discharge face by pressing the somewhat hard rubber blade against the ink discharge face of the print head, and sliding the blade over the ink discharge face, which places a great force on the ink discharge face, and may damage the ink discharge face.

Also, while the blade is solely dependent on the wiping effects, wiping alone may leave ink in the ink discharge orifices. Using multiple blades also has the same problems, in that the ink discharge face may be damaged, and that ink may be left in the ink discharge orifices.

SUMMARY OF THE INVENTION

The present invention has been made in order to deal with the above-described problems, and accordingly, it is an object to provide an image formation apparatus and a control method thereof with improved cleaning effects near the ink discharge orifices without damaging the ink discharge face, by bringing the perimeter face of the cleaning member into contact with the ink discharge face and moving, each time a predetermined number of sheets of the recording medium have images formed thereupon, or each time a predetermined amount of time elapses, following starting of the operations for forming images.

To achieve the above objects, according to a first aspect of the present invention, an image formation apparatus comprises: a cleaning member cylindrically formed of a material having elasticity; moving means for moving both the peripheral face of the cleaning member and the ink discharge face of the print head relative one to another, with both in contact one with another; and driving control means for controlling the driving of the moving means; wherein, each time a predetermined number of sheets of the recording medium have images formed thereupon following starting of the operations for forming images, the image formation operations are temporarily interrupted, and the moving means are driven under the control of the driving control means, and the peripheral face of the cleaning member is moved over the surface of the ink discharge face while in contact therewith, thereby suctioning the ink within the ink discharge orifices.

According to such a configuration, each time a predetermined number of sheets of the recording medium have images formed thereupon following starting of the operations for forming images, the image formation operations are temporarily interrupted, and the moving means are driven under the control of the driving control means, and the peripheral face of the cleaning member formed on a cylindrical shape of a material having elasticity is moved over the surface of the ink discharge face while in contact therewith, thereby suctioning and removing the ink within the ink discharge orifices by the elastic deformation of the cleaning member. Thus, cleaning effects near the ink discharge orifices are improved without damaging the ink discharge face of the print head.

The image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face while in contact therewith in conjunction with the opening action of the cap member, and wherein the cap member is temporarily closed and then opened again during interruption of the image formation operations. Thus, the cap member stores the cleaning member therein and also protects the ink discharge face of the print head, and the cleaning member is relatively moved over the ink discharge face in conjunction with the opening action of the cap member. The ink within the ink discharge orifices is suctioned and removed by the elastic deformation of the cleaning member when moving.

Or, the image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face while in contact therewith in conjunction with the closing action of the cap member, and wherein the cap member is temporarily closed and then opened again during interruption of the image formation operations. Thus, the cap member stores the cleaning member therein and also protects the ink discharge face of the print head, and the cleaning member is relatively moved over the ink discharge face in conjunction with the closing action of the cap member. The ink within the ink discharge orifices is suctioned and removed by the elastic deformation of the cleaning member when moving.

According to a second aspect of the present invention, an image formation apparatus comprises: a cleaning member cylindrically formed of a material having elasticity; moving means for moving both the peripheral face of the cleaning member and the ink discharge face of the print head relative one to another, with both in contact one with another; driving control means for controlling the driving of the moving means; and discharge control means for controlling discharge operations of ink from ink discharge orifices on the ink discharge face; wherein, each time a predetermined number of sheets of the recording medium have images formed thereupon following starting of the operations for forming images, the image formation operations are temporarily interrupted, and the moving means are driven under the control of the driving control means, and the peripheral face of the cleaning member is moved over the surface of the ink discharge face while in contact therewith, thereby suctioning the ink within the ink discharge orifices, and further wherein, following the cleaning member moving over the ink discharge face, under control of the discharge control means, preliminary discharge of ink from the ink discharge orifices is performed.

According to such a configuration, each time a predetermined number of sheets of the recording medium have images formed thereupon following starting of the operations for forming images, the image formation operations are temporarily interrupted, and the moving means are driven under the control of the driving control means, and the peripheral face of the cleaning member formed on a cylindrical shape of a material having elasticity is moved over the surface of the ink discharge face while in contact therewith, thereby suctioning the ink within the ink discharge orifices by the elastic deformation of the cleaning member, and further, following the cleaning member moving over the ink discharge face, under control of the discharge control means, preliminary discharge of ink from the ink discharge orifices is performed. Thus, cleaning effects near the ink discharge orifices are improved without damaging the ink discharge face of the print head, due to the suction of the ink within the ink discharge orifices, and the subsequent preliminary discharging of ink.

The image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face while in contact therewith in conjunction with the opening action of the cap member, and wherein the cap member is temporarily closed and then opened again during interruption of the image formation operations. Thus, the cap member stores the cleaning member therein and also protects the ink discharge face of the print head, and the peripheral face of the cleaning member is relatively moved over the surface of the ink discharge face in conjunction with the opening action of the cap member. The ink within the ink discharge orifices is suctioned and removed by the elastic deformation of the cleaning member when moving, and following the cleaning member moving over the ink discharge face, the preliminary discharge of ink is performed from the ink discharge orifices.

Or, the image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face while in contact therewith in conjunction with the closing action of the cap member, and wherein the cap member is temporarily closed and then opened again during interruption of the image formation operations.

Thus, the cap member stores the cleaning member therein and also protects the ink discharge face of the print head, and the cleaning member is relatively moved over the ink discharge face in conjunction with the closing action of the cap member. The ink within the ink discharge orifices is suctioned and removed by the elastic deformation of the cleaning member when moving, and following the cleaning member moving over the ink discharge face, the preliminary discharge of ink is performed from the ink discharge orifices.

According to a third aspect of the present invention, an image formation apparatus comprises: a cleaning member cylindrically formed of a material having elasticity; moving means for moving both the peripheral face of the cleaning member and the ink discharge face of the print head relative one to another, with both in contact one with another; driving control means for controlling the driving of the moving means; and discharge control means for controlling discharge operations of ink from ink discharge orifices on the ink discharge face; wherein, each time a predetermined number of sheets of the recording medium have images formed thereupon following starting of the operations for forming images, the image formation operations are temporarily interrupted, and discharge operations of ink from ink discharge orifices are performed under control of the discharge control means, whereby preliminary discharge of ink from the ink discharge orifices is performed.

According to such a configuration, each time a predetermined number of sheets of the recording medium have images formed thereupon following starting of the operations for forming images, the image formation operations are temporarily interrupted, and discharge operations of ink from ink discharge orifices are performed under control of the discharge control means, whereby preliminary discharge of ink from the ink discharge orifices is performed. Thus, cleaning effects near the ink discharge orifices are improved without damaging the ink discharge face of the print head.

The image formation apparatus may further comprise a cap member for storing the cleaning member therein and also protecting the ink discharge face of the print head, wherein opening and closing of the cap member is performed by driving the moving means such that the cleaning member and the print head are relatively moved in conjunction with the opening action of the cap member, and wherein the cap member is temporarily closed and then opened again during interruption of the image formation operations. The cap member thus stores the cleaning member therein and also protects the ink discharge face of the print head, and the cleaning member and the print head are relatively moved in conjunction with the opening action of the cap member.

Or, image formation apparatus may further comprise a cap member for storing the cleaning member therein and also protecting the ink discharge face of the print head, wherein opening and closing of the cap member is performed by driving the moving means such that the cleaning member and the print head are relatively moved in conjunction with the closing action of the cap member, and wherein the cap member is temporarily closed and then opened again during interruption of the image formation operations. The cap member thus stores the cleaning member therein and also protects the ink discharge face of the print head, and the cleaning member and the ink discharge face are relatively moved in conjunction with the closing action of the cap member.

According to a fourth aspect of the present invention, an image formation apparatus having a print head with an ink discharge face where rows of ink discharge orifices for each of a plurality of colors are provided, whereby ink is discharged from the ink discharge orifices so as to form an image on a recording medium, comprises: a cleaning member cylindrically formed of a material having elasticity; a cap member for storing the cleaning member therein and also protecting the ink discharge face of the print head; cap opening/closing means for opening and closing the cap member, so that the peripheral face of the cleaning member and the ink discharge face of the print head are moved relative one to another in a direction orthogonal to the rows of ink discharge orifices for each color, with both in contact one with another, in conjunction with the opening action of the cap member; driving control means for controlling the driving of the cap opening/closing means; and discharge control means for controlling discharge operations of ink from ink discharge orifices on the ink discharge face; wherein, each time a predetermined number of sheets of the recording medium have images formed thereupon following starting of the operations for forming images, the image formation operations are temporarily interrupted, and the cap opening/closing means are driven under the control of the driving control means to temporarily close the cap member and then reopen, and the peripheral face of the cleaning member is moved over the surface of the ink discharge face while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

According to such a configuration, each time a predetermined number of sheets of the recording medium have images formed thereupon following starting of the operations for forming images, the image formation operations are temporarily interrupted, and the cap opening/closing means are driven under the control of the driving control means to temporarily close the cap member and then reopen, and the peripheral face of the cleaning member and the ink discharge face of the print head are moved relative one to another in a direction orthogonal to the rows of ink discharge orifices for each color while in contact with each other, thereby suctioning the ink within the ink discharge orifices due to the elastic deformation of the cleaning member when moving, in conjunction with the opening action of the cap member for storing the cleaning member cylindrically formed of a material having elasticity therein and also protecting the ink discharge face of the print head, and following the cleaning member moving over the ink discharge face, under control of the discharge control means, preliminary discharge of ink from the ink discharge orifices is performed in the order of the rows of ink discharge orifices of each color on the ink discharge face which the cleaning member has passed over. Thus, cleaning effects near the ink discharge orifices are improved without damaging the ink discharge face of the print head, due to the suction of the ink within the ink discharge orifices, and the subsequent preliminary discharging of ink.

According to a fifth aspect of the present invention, an image formation apparatus having a print head with an ink discharge face where rows of ink discharge orifices for each of a plurality of colors are provided, whereby ink is discharged from the ink discharge orifices so as to form an image on a recording medium, comprises: a cleaning member cylindrically formed of a material having elasticity; a cap member for storing the cleaning member therein and also protecting the ink discharge face of the print head; cap opening/closing means for opening and closing the cap member, so that the peripheral face of the cleaning member and the ink discharge face of the print head are moved relative one to another in a direction orthogonal to the rows of ink discharge orifices for each color, with both in contact one with another, in conjunction with the closing action of the cap member; driving control means for controlling the driving of the cap opening/closing means; and discharge control means for controlling discharge operations of ink from ink discharge orifices on the ink discharge face; wherein, each time a predetermined number of sheets of the recording medium have images formed thereupon following starting of the operations for forming images, the image formation operations are temporarily interrupted, and the cap opening/closing means are driven under the control of the driving control means to temporarily close the cap member and then reopen, and the peripheral face of the cleaning member is moved over the surface of the ink discharge face while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

According to such a configuration, each time a predetermined number of sheets of the recording medium have images formed thereupon following starting of the operations for forming images, the image formation operations are temporarily interrupted, and the cap opening/closing means are driven under the control of the driving control means to temporarily close the cap member and then reopen, and the peripheral face of the cleaning member and the ink discharge face of the print head are moved relative one to another in a direction orthogonal to the rows of ink discharge orifices for each color while in contact with each other, thereby suctioning the ink within the ink discharge orifices due to the elastic deformation of the cleaning member when moving, in conjunction with the closing action of the cap member for storing the cleaning member cylindrically formed of a material having elasticity therein and also protecting the ink discharge face of the print head, and following the cleaning member moving over the ink discharge face, under control of the discharge control means, preliminary discharge of ink from the ink discharge orifices is performed in the order of the rows of ink discharge orifices of each color on the ink discharge face which the cleaning member has passed over. Thus, cleaning effects near the ink discharge orifices are improved without damaging the ink discharge face of the print head, due to the suction of the ink within the ink discharge orifices, and the subsequent preliminary discharging of ink.

According to a sixth aspect of the present invention, an image formation apparatus comprises: a cleaning member cylindrically formed of a material having elasticity; moving means for moving both the peripheral face of the cleaning member and the ink discharge face of the print head relative one to another, with both in contact one with another; and driving control means for controlling the driving of the moving means; wherein, each time a predetermined amount of time elapses following starting of the operations for forming images on the recording medium, the image formation operations are temporarily interrupted, and the moving means are driven under the control of the driving control means, and the peripheral face of the cleaning member is moved over the surface of the ink discharge face while in contact therewith, thereby suctioning the ink within the ink discharge orifices.

According to such a configuration, each time a predetermined amount of time elapses following starting of the operations for forming images, the image formation operations are temporarily interrupted, and the moving means are driven under the control of the driving control means, and the peripheral face of the cleaning member formed on a cylindrical shape of a material having elasticity is relatively moved over the surface of the ink discharge face while in contact therewith, thereby suctioning and removing the ink within the ink discharge orifices by the elastic deformation of the cleaning member when moving. Thus, cleaning effects near the ink discharge orifices are improved without damaging the ink discharge face of the print head.

The image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face of the print head while in contact therewith in conjunction with the opening action of the cap member, and wherein the cap member is temporarily closed and then opened again during interruption of the image formation operations. Thus, the cleaning member is stored within the cap member and the ink discharge face of the print head is protected, and the cleaning member and the ink discharge face are moved relative one to another. The elastic deformation of the cleaning member at the time of this moving suctions and removes the ink within the ink discharge orifices.

Or, the image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face of the print head while in contact therewith in conjunction with the closing action of the cap member, and wherein the cap member is temporarily closed and then opened again during interruption of the image formation operations. Thus, the cleaning member is stored within the cap member and the ink discharge face of the print head is protected, and the cleaning member and the ink discharge face are moved relative one to another. The elastic deformation of the cleaning member at the time of this moving suctions and removes the ink within the ink discharge orifices.

According to a seventh aspect of the present invention, an image formation apparatus comprises: a cleaning member cylindrically formed of a material having elasticity; moving means for moving both the peripheral face of the cleaning member and the ink discharge face of the print head relative one to another, with both in contact one with another; driving control means for controlling the driving of the moving means; and discharge control means for controlling discharge operations of ink from ink discharge orifices on the ink discharge face; wherein, each time a predetermined amount of time elapses following starting of the operations for forming images on the recording medium, the image formation operations are temporarily interrupted, and the moving means are driven under the control of the driving control means, and the peripheral face of the cleaning member is moved over the surface of the ink discharge face while in contact therewith, thereby suctioning the ink within the ink discharge orifices, and further wherein, following the cleaning member moving over the ink discharge face, under control of the discharge control means, preliminary discharge of ink from the ink discharge orifices is performed.

According to such a configuration, each time a predetermined amount of time elapses following starting of the operations for forming images, the image formation operations are temporarily interrupted, and the moving means are driven under the control of the driving control means, and the peripheral face of the cleaning member formed on a cylindrical shape of a material having elasticity is moved over the surface of the ink discharge face while in contact therewith, thereby suctioning the ink within the ink discharge orifices by the elastic deformation of the cleaning member, and further, following the cleaning member moving over the ink discharge face, under control of the discharge control means, preliminary discharge of ink from the ink discharge orifices is performed. Thus, cleaning effects near the ink discharge orifices are improved without damaging the ink discharge face of the print head, due to the suction of the ink within the ink discharge orifices, and the subsequent preliminary discharging of ink.

The image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face of the print head while in contact therewith in conjunction with the opening action of the cap member, and wherein the cap member is temporarily closed and then opened again during interruption of the image formation operations. Thus, the cleaning member is stored within the cap member and the ink discharge face of the print head is protected, and the cleaning member and the ink discharge face are moved relative one to another. The elastic deformation of the cleaning member at the time of this moving suctions and removes the ink within the ink discharge orifices, and preliminary discharge of ink is performed form the ink discharge orifices following the cleaning member moving over the ink discharge face.

Or, the image formation apparatus may further comprise a cap member for storing the cleaning member therein and also protecting the ink discharge face of the print head, wherein opening and closing of the cap member is performed by driving the moving means such that the peripheral face of the cleaning member is relatively moved over the surface of the ink discharge face while in contact therewith in conjunction with the closing action of the cap member, and wherein the cap member is temporarily closed and then opened again during interruption of the image formation operations.

Thus, the cap member stores the cleaning member therein and also protects the ink discharge face of the print head, and the cleaning member is relatively moved over the ink discharge face in conjunction with the closing action of the cap member. The ink within the ink discharge orifices is suctioned by the elastic deformation of the cleaning member when moving, and following the cleaning member moving over the ink discharge face, the preliminary discharge of ink is performed from the ink discharge orifices.

According to an eighth aspect of the present invention, an image formation apparatus comprises: a cleaning member cylindrically formed of a material having elasticity; moving means for moving both the peripheral face of the cleaning member and the ink discharge face of the print head relative one to another, with both in contact one with another; driving control means for controlling the driving of the moving means; and discharge control means for controlling discharge operations of ink from ink discharge orifices on the ink discharge face; wherein, each time a predetermined amount of time elapses following starting of the operations for forming images on the recording medium, the image formation operations are temporarily interrupted, and discharge operations of ink from ink discharge orifices are performed under control of the discharge control means, whereby preliminary discharge of ink from the ink discharge orifices is performed.

Due to such a configuration, each time a predetermined amount of time elapses following starting of the operations for forming images on the recording medium, the image formation operations are temporarily interrupted, and discharge operations of ink from ink discharge orifices are performed under control of the discharge control means, whereby preliminary discharge of ink from the ink discharge orifices is performed. Thus, cleaning effects near the ink discharge orifices are improved without damaging the ink discharge face of the print head.

The image formation apparatus may further comprise a cap member for storing the cleaning member therein and also protecting the ink discharge face of the print head, wherein opening and closing of the cap member is performed by driving the moving means such that the peripheral face of the cleaning member and the ink discharge face of the print head are relatively moved with both in contact one with another in conjunction with the opening action of the cap member, and wherein the cap member is temporarily closed and then opened again during interruption of the image formation operations. Thus, the cap member stores the cleaning member therein and also protects the ink discharge face of the print head, and the cleaning member is relatively moved over the ink discharge face in conjunction with the closing action of the cap member.

Or, the image formation apparatus may further comprise a cap member for storing the cleaning member therein and also protecting the ink discharge face of the print head, wherein opening and closing of the cap member is performed by driving the moving means such that the peripheral face of the cleaning member and the ink discharge face of the print head are relatively moved with both in contact one with another in conjunction with the closing action of the cap member, and wherein the cap member is temporarily closed and then opened again during interruption of the image formation operations. Thus, the cap member stores the cleaning member therein and also protects the ink discharge face of the print head, and the cleaning member is relatively moved over the ink discharge face in conjunction with the closing action of the cap member.

According to a ninth aspect of the present invention, an image formation apparatus having a print head with an ink discharge face where rows of ink discharge orifices for each of a plurality of colors are provided, whereby ink is discharged from the ink discharge orifices so as to form an image on a recording medium, comprises: a cleaning member cylindrically formed of a material having elasticity; a cap member for storing the cleaning member therein and also protecting the ink discharge face of the print head; cap opening/closing means for opening and closing the cap member, so that the peripheral face of the cleaning member and the ink discharge face of the print head are moved relative one to another in a direction orthogonal to the rows of ink discharge orifices for each color, with both in contact one with another, in conjunction with the opening action of the cap member; driving control means for controlling the driving of the cap opening/closing means; and discharge control means for controlling discharge operations of ink from ink discharge orifices on the ink discharge face; wherein, each time a predetermined amount of time elapses following starting of the operations for forming images, the image formation operations are temporarily interrupted, and the cap opening/closing means are driven under the control of the driving control means to temporarily close the cap member and then reopen, and the peripheral face of the cleaning member is moved over the surface of the ink discharge face while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

According to such a configuration, each time a predetermined amount of time elapses following starting of the operations for forming images, the image formation operations are temporarily interrupted, and the cap opening/closing means are driven under the control of the driving control means to temporarily close the cap member and then reopen, and the peripheral face of the cleaning member and the ink discharge face of the print head are moved relative one to another in a direction orthogonal to the rows of ink discharge orifices for each color while in contact with each other, thereby suctioning the ink within the ink discharge orifices due to the elastic deformation of the cleaning member when moving, in conjunction with the opening action of the cap member for storing the cleaning member cylindrically formed of a material having elasticity therein and also protecting the ink discharge face of the print head, and following the cleaning member moving over the ink discharge face, under control of the discharge control means, preliminary discharge of ink from the ink discharge orifices is performed in the order of the rows of ink discharge orifices of each color on the ink discharge face which the cleaning member has passed over. Thus, cleaning effects near the ink discharge orifices are improved without damaging the ink discharge face of the print head, due to the suction of the ink within the ink discharge orifices, and the subsequent preliminary discharging of ink.

Further, according to a tenth aspect of the present invention, an image formation apparatus having a print head with an ink discharge face where rows of ink discharge orifices for each of a plurality of colors are provided, whereby ink is discharged from the ink discharge orifices so as to form an image on a recording medium, comprises: a cleaning member cylindrically formed of a material having elasticity; a cap member for storing the cleaning member therein and also protecting the ink discharge face of the print head; cap opening/closing means for opening and closing the cap member, so that the peripheral face of the cleaning member and the ink discharge face of the print head are moved relative one to another in a direction orthogonal to the rows of ink discharge orifices for each color, with both in contact one with another, in conjunction with the closing action of the cap member; driving control means for controlling the driving of the cap opening/closing means; and discharge control means for controlling discharge operations of ink from ink discharge orifices on the ink discharge face; wherein, each time a predetermined amount of time elapses following starting of the operations for forming images on the recording medium, the image formation operations are temporarily interrupted, and the cap opening/closing means are driven under the control of the driving control means to temporarily close the cap member and then reopen, and the peripheral face of the cleaning member is moved over the surface of the ink discharge face while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

According to such a configuration, each time a predetermined amount of time elapses following starting of the operations for forming images, the image formation operations are temporarily interrupted, and the cap opening/closing means are driven under the control of the driving control means to temporarily close the cap member and then reopen, and the peripheral face of the cleaning member and the ink discharge face of the print head are moved relative one to another in a direction orthogonal to the rows of ink discharge orifices for each color while in contact with each other, thereby suctioning the ink within the ink discharge orifices due to the elastic deformation of the cleaning member when moving, in conjunction with the closing action of the cap member for storing the cleaning member cylindrically formed of a material having elasticity therein and also protecting the ink discharge face of the print head, and following the cleaning member moving over the ink discharge face, under control of the discharge control means, preliminary discharge of ink from the ink discharge orifices is performed in the order of the rows of ink discharge orifices of each color on the ink discharge face which the cleaning member has passed over. Thus, cleaning effects near the ink discharge orifices are improved without damaging the ink discharge face of the print head, due to the suction of the ink within the ink discharge orifices, and the subsequent preliminary discharging of ink.

According to another aspect of the present invention, with a control method for an image formation apparatus, each time a predetermined number of sheets of the recording medium have images formed thereupon following starting of the operations for forming images, the image formation operations are temporarily interrupted, and the moving means are driven under the control of the driving control means, and the peripheral face of the cleaning member cylindrically formed of a material having elasticity is moved over the surface of the ink discharge face wherein ink discharge orifices are provided while in contact therewith, thereby suctioning the ink within the ink discharge orifices.

Thus, cleaning effects near the ink discharge orifices are improved without damaging the ink discharge face of the print head.

According to yet another aspect of the present invention, with a control method for an image formation apparatus, each time a predetermined number of sheets of the recording medium have images formed thereupon following starting of the operations for forming images, the image formation operations are temporarily interrupted, and the moving means are driven under the control of the driving control means, and the peripheral face of the cleaning member cylindrically formed of a material having elasticity is moved over the surface of the ink discharge face wherein ink discharge orifices are provided while in contact therewith, thereby suctioning the ink within the ink discharge orifices, and further wherein, following the cleaning member moving over the ink discharge face, under control of the discharge control means, preliminary discharge of ink from the ink discharge orifices is performed.

Thus, cleaning effects near the ink discharge orifices are improved without damaging the ink discharge face of the print head, due to the suction of the ink within the ink discharge orifices, and the subsequent preliminary discharging of ink.

According to yet another aspect of the present invention, with a control method for an image formation apparatus, each time a predetermined number of sheets of the recording medium have images formed thereupon following starting of the operations for forming images, the image formation operations are temporarily interrupted, and the discharge operations of ink from ink discharge orifices are performed under control of the discharge control means, whereby control is effected such that preliminary discharge of ink from the ink discharge orifices is performed.

Thus, cleaning effects near the ink discharge orifices are improved without damaging the ink discharge face of the print head.

According to yet another aspect of the present invention, with a control method for an image formation apparatus, each time a predetermined number of sheets of the recording medium have images formed thereupon following starting of the operations for forming images, the image formation operations are temporarily interrupted, and the cap opening/closing means are driven under the control of the driving control means to open the cap member, and the peripheral face of the cleaning member cylindrically formed of a material having elasticity is moved over the surface of the ink discharge face where rows of ink discharge orifices of each color are provided while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

Thus, cleaning effects near the ink discharge orifices are improved without damaging the ink discharge face of the print head, due to the suction of the ink within the ink discharge orifices, and the subsequent preliminary discharging of ink.

According to yet another aspect of the present invention, with a control method for an image formation apparatus, each time a predetermined number of sheets of the recording medium have images formed thereupon following starting of the operations for forming images, the image formation operations are temporarily interrupted, and the cap opening/closing means are driven under the control of the driving control means to close the cap member, and the peripheral face of the cleaning member cylindrically formed of a material having elasticity is moved over the surface of the ink discharge face where rows of ink discharge orifices of each color are provided while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

Thus, cleaning effects near the ink discharge orifices are improved without damaging the ink discharge face of the print head, due to the suction of the ink within the ink discharge orifices, and the subsequent preliminary discharging of ink.

According to yet another aspect of the present invention, with a control method for an image formation apparatus, each time a predetermined amount of time elapses following starting of the operations for forming images on the recording medium, the image formation operations are temporarily interrupted, and the moving means are driven under the control of the driving control means, and the peripheral face of the cleaning member cylindrically formed of a material having elasticity is moved over the surface of the ink discharge face wherein ink discharge orifices are provided while in contact therewith, thereby suctioning the ink within the ink discharge orifices.

Thus, cleaning effects near the ink discharge orifices are improved without damaging the ink discharge face of the print head.

According to yet another aspect of the present invention, with a control method for an image formation apparatus, each time a predetermined amount of time elapses following starting of the operations for forming images on the recording medium, the image formation operations are temporarily interrupted, and the moving means are driven under the control of the driving control means, and the peripheral face of the cleaning member cylindrically formed of a material having elasticity is moved over the surface of the ink discharge face wherein ink discharge orifices are provided while in contact therewith, thereby suctioning the ink within the ink discharge orifices, and further wherein, following the cleaning member moving over the ink discharge face, under control of the discharge control means, preliminary discharge of ink from the ink discharge orifices is performed.

Thus, cleaning effects near the ink discharge orifices are improved without damaging the ink discharge face of the print head, due to the suction of the ink within the ink discharge orifices, and the subsequent preliminary discharging of ink.

According to yet another aspect of the present invention, with a control method for an image formation apparatus, each time a predetermined amount of time elapses following starting of the operations for forming images on the recording medium, the image formation operations are temporarily interrupted, and discharge operations of ink from ink discharge orifices are performed under control of the discharge control means, whereby preliminary discharge of ink from the ink discharge orifices is performed.

Thus, cleaning effects near the ink discharge orifices are improved without damaging the ink discharge face of the print head.

According to yet another aspect of the present invention, with a control method for an image formation apparatus, each time a predetermined amount of time elapses following starting of the operations for forming images, the image formation operations are temporarily interrupted, and the cap opening/closing means are driven under the control of the driving control means to open the cap member, and the peripheral face of the cleaning member cylindrically formed of a material having elasticity is moved over the surface of the ink discharge face where rows of ink discharge orifices of each color are provided while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

Thus, cleaning effects near the ink discharge orifices are improved without damaging the ink discharge face of the print head, due to the suction of the ink within the ink discharge orifices, and the subsequent preliminary discharging of ink.

According to yet another aspect of the present invention, with a control method for an image formation apparatus, each time a predetermined amount of time elapses following starting of the operations for forming images on the recording medium, the image formation operations are temporarily interrupted, and the cap opening/closing means are driven under the control of the driving control means to close the cap member, and the peripheral face of the cleaning member cylindrically formed of a material having elasticity is moved over the surface of the ink discharge face where rows of ink discharge orifices of each color are provided while in contact therewith, thereby suctioning the ink within the ink discharge orifices, and further wherein, following the cleaning member moving over the ink discharge face, under control of the discharge control means, preliminary discharge of ink from the ink discharge orifices is performed in the order of the rows of ink discharge orifices of each color on the ink discharge face which the cleaning member has passed over.

Thus, cleaning effects near the ink discharge orifices are improved without damaging the ink discharge face of the print head, due to the suction of the ink within the ink discharge orifices, and the subsequent preliminary discharging of ink.

Finally, closing the cap member following the image formation operations prevents drying and clogging of the ink discharge orifices of the print head.

DESCRIPTION OF THE PREFERRED EMBODIMENTS

The following is a detailed description of embodiments of the present invention, with reference to the attached drawings.

Figure 1:
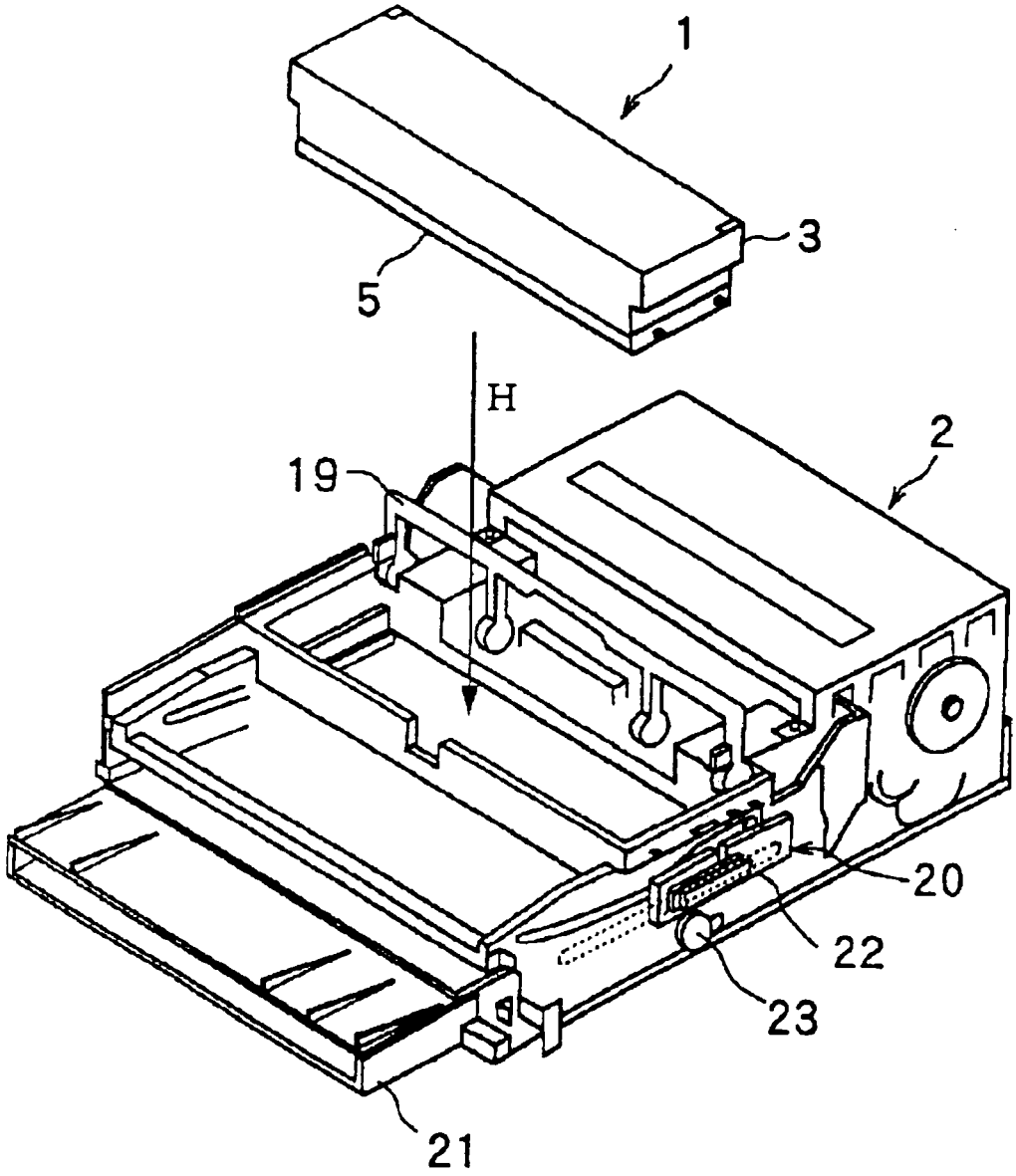
FIG. 1 is a perspective view illustrating an embodiment of an image formation apparatus according to the present invention, more specifically, an ink jet printer.

FIG. 1 is a perspective view illustrating an embodiment of an image formation apparatus according to the present invention, more specifically, an ink jet printer. The ink jet printer shown is of a type wherein an ink jet head 1 has an independent form and is directly mounted to a printer main unit 2. The ink jet head ink jet head 1 is set to the printer main unit 2 in a fixed manner as indicated by the arrow H in the drawing.

The ink jet head 1 discharges liquid ink by forming fine particles of the liquid ink using electro-thermal conversion or electromechanical conversion for example, and sprays the ink onto a recording medium such as recording paper. The ink jet head 1 comprises an ink cartridge 3, a print head 4, and a head cap 5, as illustrated in FIGS. 1 and 2.

The ink cartridge 3 is for storing one or multiple colors of ink therein, having a casing with a narrow and long shape extending in the width direction of the printer main unit 2 shown in FIG. 1, i.e., over the entire width of the width direction of the recording sheets. Though omitted in the drawings, the inside of the casing is divided into four ink chambers for example, with ink of the four colors of Y (yellow), M (magenta), C (cyan), and K (black) filled therein. The ink cartridge 3 is formed of a hard resin or the like.

Figure 2:
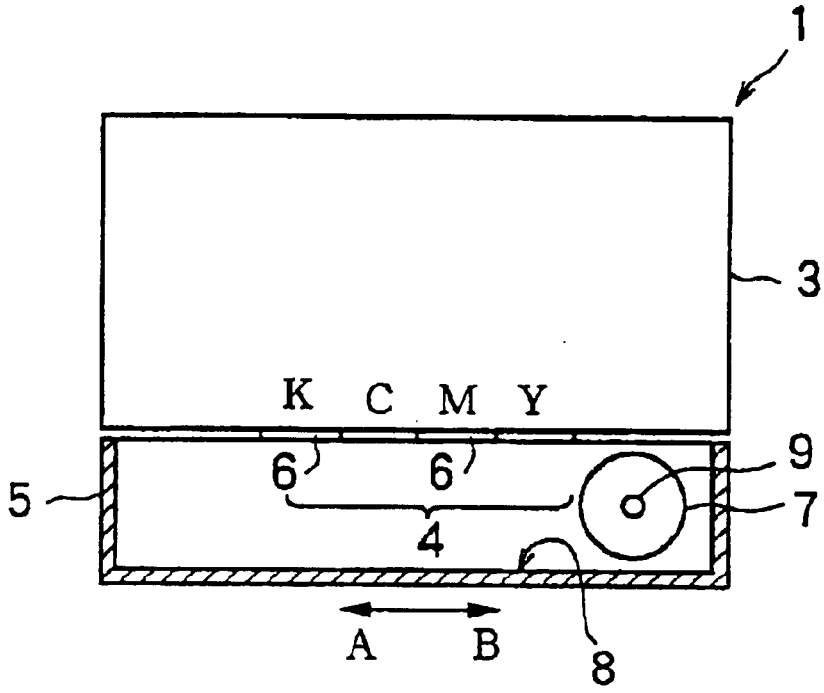
FIG. 2 is an enlarged cross-sectional diagram of an ink jet head shown in FIG. 1.

As shown in FIG. 2 (the enlarged cross-sectional view of the ink jet head shown in FIG. 1), a print head 4 is provided on the bottom of the ink cartridge 3. The print head 4 is for forming fine particles of the ink supplied from the ink cartridge 3, and spraying. Ink discharge orifices formed of minute holes are arrayed in the longitudinal direction of the ink cartridge 3 over the entire width thereof, which covers the entire width of the recording sheets, thereby forming an ink discharge face 6.

The ink discharge face 6 is formed in a thin sheet by nickel electroforming using nickel and a material containing nickel for example, so rows of ink discharge orifices for the four colors of Y (yellow), M (magenta), C (cyan), and K (black) each extend in the longitudinal direction of the ink cartridge 3, thereby forming a four-color integrated line head.

Though omitted in the drawings, portions of the ink discharge face 6 where the rows of the ink discharge orifices for Y, M, C, and K are provided, and portions where protrusions covering head electrodes with resin on both sides of the ink discharge orifices, are formed in an undulated manner.

The head cap 5 is attached to the base side of the ink cartridge 3. This head cap 5 stores a later-described cleaning roller 7 therein, and also serves as a protecting cap member for covering the ink discharge face 6 of the print head 4 in order to prevent drying and clogging of the ink discharge orifices, and is formed in a narrow shape extending the same length of the casing of the ink cartridge 3. The shape is that of a shallow box with the upper face open, and is detachably mounted to the print head 4 so as to be relatively movable thereto.

The head cap 5 is moved in the directions of the arrows A and B orthogonal to the longitudinal direction of the ink discharge face 6 of the print head 4, being driven by moving means such as a motor or the like, and is removed from the ink cartridge 3 by moving in the direction of the arrow A and mounted the ink cartridge 3 by returning in the direction of the arrow B. The head cap 5 is formed of a hard resin or the like.

A cleaning roller 7 is provided on the inside of the head cap 5. The cleaning roller 7 serves as a cleaning member for cleaning the ink discharge face 6 of the print head 4, and is cylindrically formed of an elastic material, and attached in the longitudinal direction of the head cap 5 at one side portion of the head cap 5.

Accordingly, the cleaning roller 7 is parallel with the longitudinal direction of the ink discharge face 6 of the print head 4. The cleaning roller 7 moves in the direction of the arrow A along with the head cap 5, so as to clean the ink discharge face 6 of the print head 4.

Also, an ink receptacle 8 is provided on the inside of the head cap 5. This ink receptacle 8 is for receiving the ink from the preliminary discharging from the ink discharge orifices of the print head 4, and is arranged so as to receive the preliminary discharge ink with a part or all of the base face of the shallow box-shaped head cap 5.

Next, a specific example of the head cap 5 and the cleaning roller 7 will be described with reference to FIGS.

3 through 5. First, in FIG. 4, the head cap 5 is formed long and slender to match the width and length of the ink cartridge 3 shown in FIG. 1, and as shown in FIG. 3, the shape is that of an open shallow box with a base face provided on the bottom thereof and walls erected on all sides.

Figure 3:
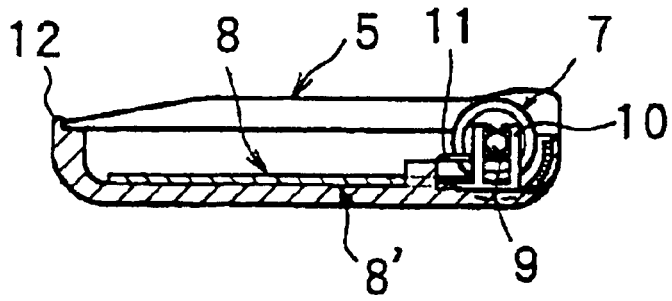
FIG. 3 is a side view illustrating a specific example of a head cap, cleaning roller, and ink receptacle shown in FIG. 2.

As described above, the head cap 5 is moved in the directions of the arrows A and B which are orthogonal to the longitudinal direction of the ink discharge face 6 of the print head 4, and a positioning claw 12 is provided on the top of the side wall at the opposite side of the cleaning roller 7 as shown in FIG. 3, to serve as positioning means for the head cap 5 to be mounted to the ink cartridge 3 when returning in the direction of the arrow B again. The positioning claw 12 engages the lower edge portion of the ink cartridge 3 so as to position the head cap 5.

The cylindrical cleaning roller 7 is detachably held near a side wall on one side in the longitudinal direction at the print head 4 side of the head cap 5, so as to be in contact with the entire length of the ink discharge face 6 of the print head 4. That is to say, both edge portions of the cleaning roller 7 have pins 9 erected as shown in FIG. 4, with the pins 9 being held by generally U-shaped holding members 10.

The upper portion of the holding members 10 form pin receiving portions which are elastically opened and closed, so pressing the pins 9 from above onto the pin receiving portions causes the pin receiving portions to open and receive the pins 9, and then to close and hold the pins 9. In reverse, pulling the pins 9 upwards opens the pin receiving portions, whereby the pins 9 can be removed therefrom.

Figure 4:
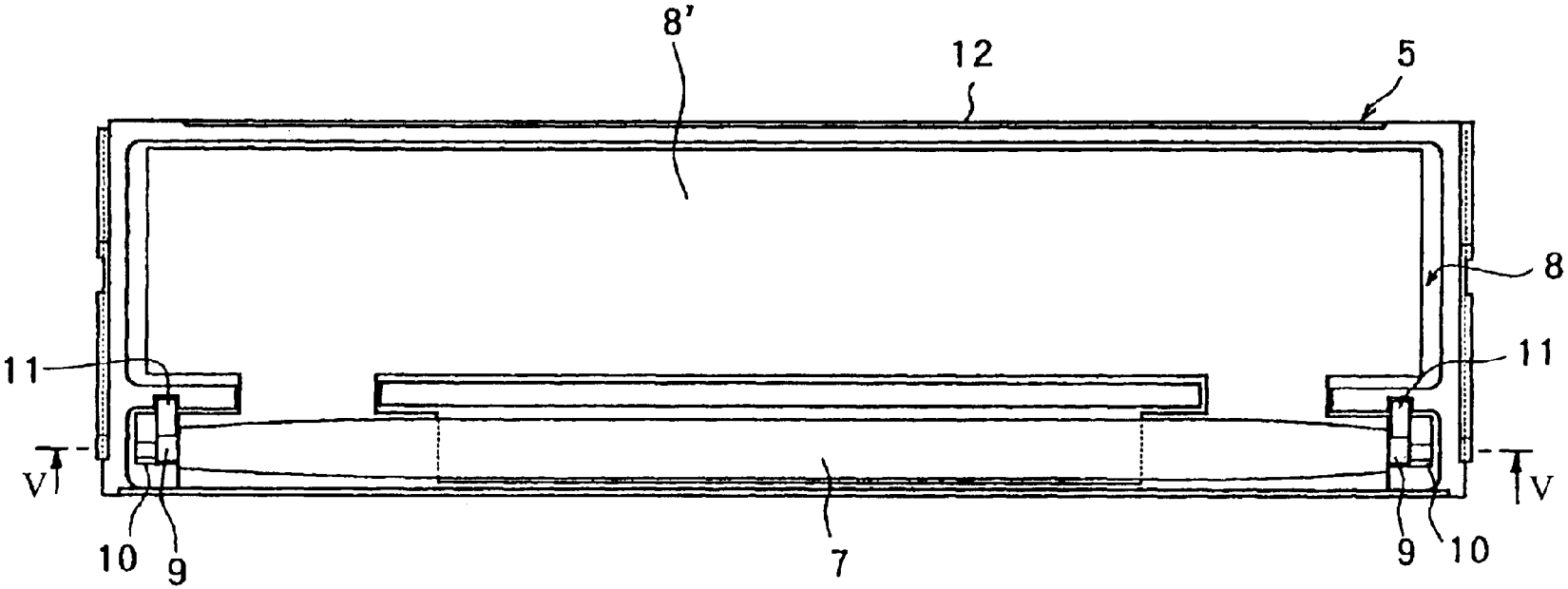
FIG. 4 is a plan view illustrating a specific example of the head cap, cleaning roller, and ink receptacle.
Figure 5:
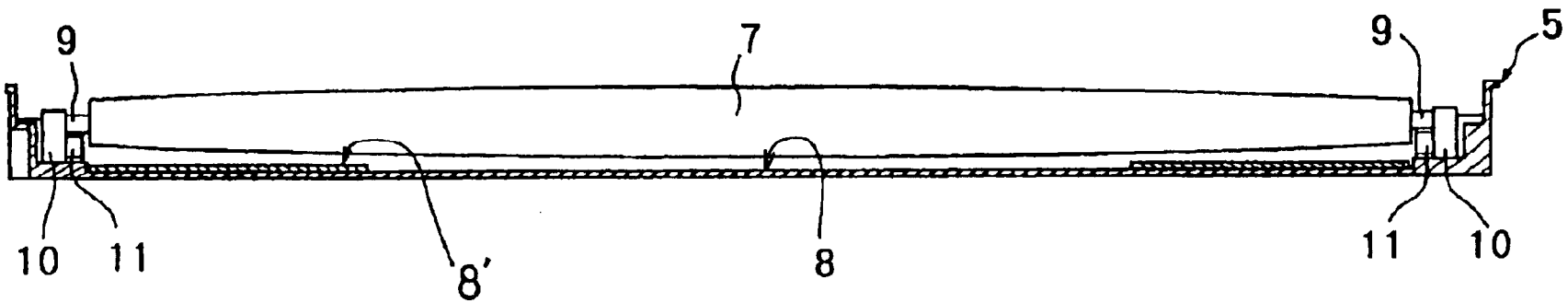
FIG. 5 is a cross-sectional view along line V—V in FIG. 4.

The cylindrical shape of the cleaning roller 7 is formed into a so-called crown shape, wherein the center portion in the longitudinal direction thereof is gradually greater in diameter, as shown in FIGS. 4 and 5. This is since the cleaning roller 7 may sag downwards at the center portion thereof in the longitudinal direction, so this shape prevents the center portion thereof from failing to come into contact with the ink discharge face 6 due to the sagging.

Also, the portion of the cleaning roller 7 which comes into contact with the ink discharge face 6 is formed of an elastic material, such as rubber. The core of the cleaning roller 7 is formed of metal or hard resin or the like, but the perimeter portion from the core is formed of an elastic material, such as rubber, though the entire cleaning roller 7 may be formed of an elastic material, such as rubber, as well.

Floating springs 11 are introduced at the portion where the cleaning roller 7 is held by the head cap 5, as shown in FIG. 3. The floating springs 11 serve as means for forcing the cleaning roller 7 against the ink discharge face 6 of the print head 4, and are formed of a leaf spring formed in a general U-shape as viewed from the side, inserted below the pins 9 near the holding members 10.

Upon the force of the floating springs 11 acting on the pins 9 on either side, the cleaning roller 7 is forced against the ink discharge face 6 of the print head 4 with a uniform force.

Thus, as shown in FIG. 2, with the head cap 5 attached to the bottom side of the ink cartridge 3, the force of the floating springs 11, the elastic force of the cleaning roller 7, and the crown shape thereof, cause the cleaning roller 7 to come into contact with the ink discharge face 6 of the print head 4, over the entire length thereof. Note that the floating spring 11 is not restricted to a generally-U-shaped leaf spring, and may be a coil spring instead.

Also, the cleaning roller 7 is arranged so as to be rotated due to contact with the ink discharge face 6 of the print head 4. Accordingly, as shown in FIG. 2, the cleaning roller 7 rotates while coming into contact with the ink discharge face 6 of the print head 4 over then entire length thereof at a suitable pressure, due to the head cap 5 moving in the direction of the arrow A, and the ink on the ink discharge face 6 is cleaned due to the rotating motion.

Now, the cleaning action of the ink discharge face 6 of the print head 4 with the cleaning roller 7 will be described with reference to FIGS. 6A through 6C. Note that in FIGS. 6A through 6C, the ink discharge face 6 and an ink discharge orifices 13 and the cleaning roller 7 are illustrated by way of an enlarged cross-sectional view, to facilitate description.

Figure 6A:
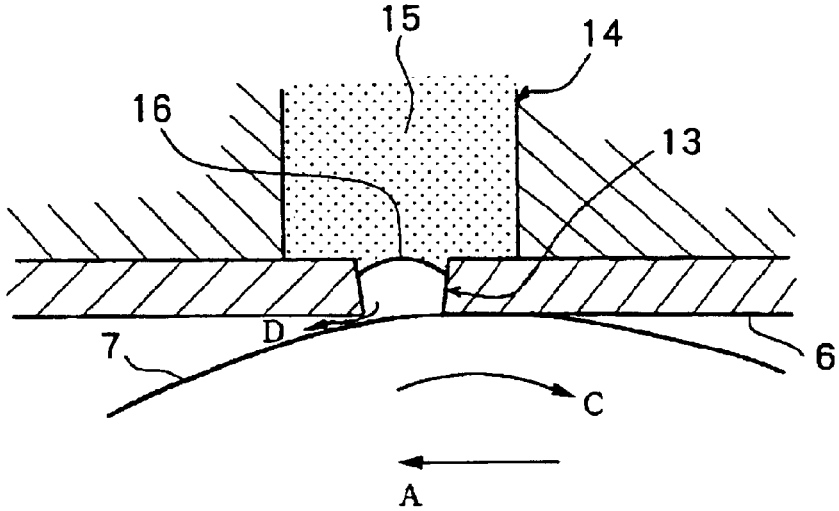
FIGS. 6A through 6C are enlarged cross-sectional diagrams describing the cleaning operations of an ink discharge face of the print head using the cleaning roller.
Figure 6B:
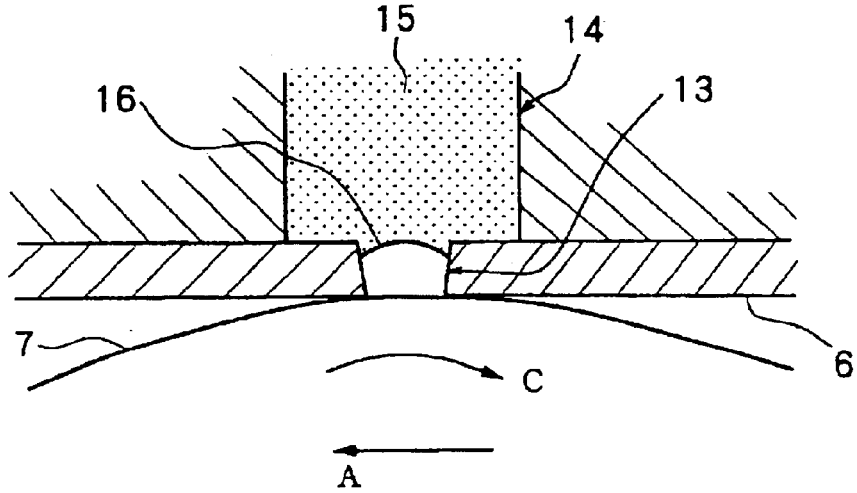
Figure 6C:
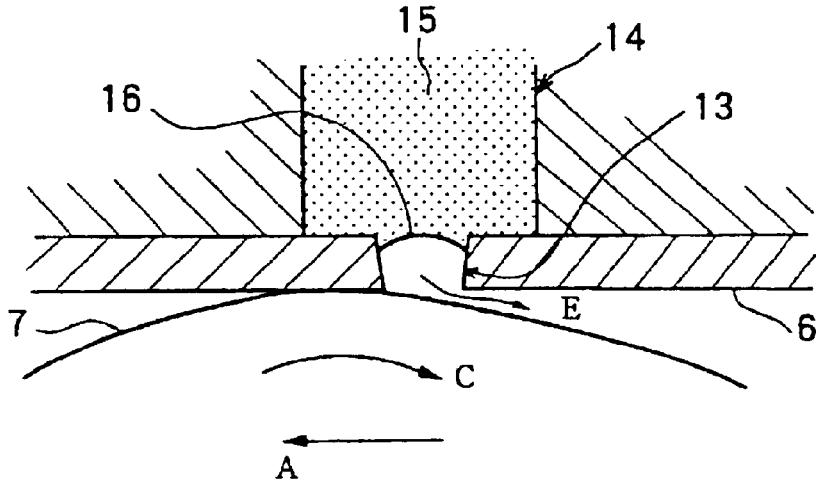

First, in FIGS. 6A through 6C, the cleaning roller 7 is rotated in the direction of the arrow C due to contact with the ink discharge face 6, while moving in the direction of the arrow A along with the head cap 5 shown in FIG. 2. In the drawings, the cleaning roller 7 is shown passing over the position of an ink discharge orifice 13 in a certain row on the ink discharge face 6 of the print head 4 in FIG. 2.

FIG. 6A shows the cleaning roller 7, which has been moving toward the direction of the arrow A while being rotated in the direction indicated by the arrow C, coming upon the position of the ink discharge orifice 13 in a certain row. At this time, the ink discharge orifice 13 portion is filled with ink 15 from the ink chamber 14, and a concave meniscus 16 is formed on the inside of the ink discharge orifice 13 due to the surface tension of the ink 15. The ink near the meniscus has a higher viscosity than that of normal ink, due to drying.

As shown in FIG. 6A, the ink discharge orifice 13 is closed off from one edge toward the other edge due to the cleaning roller 7 moving in the direction of the arrow A while being rotated in the direction of the arrow C, at this time, the air within the ink discharge orifice 13 is pushed out from the gap at the other edge as indicated by the arrow D.

Next, as shown in FIG. 6B, the cleaning roller 7 further moves in the direction of the arrow A while being rotated in the direction of the arrow C, and upon reaching the position directly above the ink discharge orifice 13, the ink discharge orifice 13 is completely closed off. At this time, the cleaning roller 7 is pressed against the ink discharge face 6, so microscopically, a portion of the surface of the cleaning roller 7 intrudes ever so slightly into the ink discharge orifice 13 between one edge and the other edge of the ink discharge orifice 13 due to the elasticity of the cleaning roller 7, and closes off the entrance to the ink discharge orifice 13 with the air of the ink discharge orifice 13 being forced out by an amount corresponding to the amount of the surface of the cleaning roller 7 which intruded into the ink discharge orifice 13, thus sealing off the inside of the ink discharge orifice 13.

At this time, depending on the state of the force on the meniscus 16 which acts to draw the meniscus back toward the ink chamber (i.e., the negative force on the meniscus), the surface of the cleaning roller 7 may come into contact with the meniscus 16, and suction the ink 15.

Subsequently, as shown in FIG. 6C, the cleaning roller 7 further moves in the direction of the arrow A while being rotated in the direction of the arrow C, and one edge portion of the ink discharge orifice 13 with the other edge thereof still closed off. At this time, microscopically, the portion of the surface of the cleaning roller 7 which has slightly intruded into the ink discharge orifice 13 departs from the one edge of the ink discharge orifice 13, which draws the air sealed inside the ink discharge orifice 13 from the gap at the one edge in the direction of the arrow E.

That is to say, as shown in FIG. 6B, the state of the pressure within the ink discharge orifice 13 changes from a state wherein the air within the ink discharge orifice 13 is pressed out and sealed as shown in FIG. 6B (positive pressure) to a state wherein the air within the ink discharge orifice 13 is drawn out as shown in FIG. 6C (negative pressure), thereby suctioning the ink within the ink discharge orifice 13. At this time, in the state in FIG. 6B, depending on the state of the force on the meniscus 16 which acts to draw the meniscus back toward the ink chamber (i.e., the negative force on the meniscus), the surface of the cleaning roller 7 may come into contact with the meniscus 16, and suctioning of the ink 15 may begin.

Accordingly, suction force acts to pull the ink remaining in the ink discharge orifice 13 in the direction towards the outer side of the print head 4 shown in FIG. 2, so the ink within the ink discharge orifice 13 can be suctioned and removed in a sure manner.

In this case, the cleaning roller 7 cylindrically formed of an elastic material such as rubber or the like is moved over the ink discharge face 6, so the ink discharge face 6 can be cleaned without damaging the protection layer of the ink discharge face 6 wherein head electrodes are covered with resin.

Now, while the cleaning roller 7 has been described as rotating due to the contact with the ink discharge face 6 of the print head 4, an arrangement may be made wherein the cleaning roller 7 does not rotate in the state of contact with the ink discharge face 6 but rather is fixed.

For example, with the arrangement in FIG. 3, two pins 9 are provided vertically on both ends of the cleaning roller 7, and the two pins 9 are inserted into generally U-shaped grooves of the holding members 10, so that the cleaning roller 7 does not rotate. In this case, the ink discharge face 6 is rubbed with the moving cleaning roller 7, so not only liquid ink adhering to the ink discharge face 6 but also solidified and caked ink can also be cleaned.

Also, the arrangement may be such that the rotations of the cleaning roller 7 are restricted with a braking mechanism, so as to rotate while rubbing the ink discharge face 6 of the print head 4. As for an example of such a braking mechanism, in FIG. 3, suitable elastic members are introduced in the portions of the holding members 10 holding the pins 9 on either side of the cleaning roller 7, so that the side faces of the cleaning roller 7 come into contact with the side faces of the elastic members, whereby suitable braking force is generated upon the cleaning roller 7 rotating.

In this case, the ink discharge face 6 is rubbed with the moving cleaning roller 7 which rotates somewhat, so not only liquid ink adhering to the ink discharge face 6 but also solidified and caked ink can also be cleaned without damaging the ink discharge face 6.

As shown in FIGS. 3 through 5, the ink receptacle 8 within the head cap 5 has an ink absorbent material 8' laid on the receiving face, which is the base face thereof. The ink absorbent material 8' serves as means for preventing splattering of ink discharged in the preliminary discharging from the print head 4, and is formed of a porous polymer material such as sponge, polyurethane, polyurethane foam, and so forth, and as shown in FIG. 4, is laid over generally the entire face of the ink receptacle 8. However, as shown in FIG. 5, the ink absorbent material 8' does not need to be provided under the large-diameter portion of the cleaning roller 7 formed in the crown shape, to avoid that portion.

Providing such an ink absorbent material 8' as described above prevents splattering of ink discharged in the preliminary discharging from the print head 4 shown in FIG. 2, and also absorbs the ink so as to not gather in the ink receptacle 8.

Accordingly, ink splattering during the preliminary discharge and re-adhering to the ink discharge face 6 can be prevented. Also, the ink discharged in the preliminary discharging can be easily cleaned by discarding the ink absorbent material 8' from the ink receptacle 8 and laying a new ink absorbent material 8'.

Now, though the embodiments shown in FIGS. 3 through 5 illustrate an example wherein the entire bottom face of the head cap 5 is used as the ink receptacle 8, the present invention is not restricted to this, and an arrangement may be made wherein a part of the bottom face is used as the ink receptacle 8. For example, in FIG. 2, an arrangement may be made wherein the cleaning roller 7 is moved somewhat toward the center, partitions are provided between the cleaning roller 7 and the side walls of the head cap 5 closer to the cleaning roller 7, and the chamber surrounded by the partition walls and the side walls is used as the ink receptacle 8. In this case, the portion where preliminary discharge of ink is made thereupon from the print head 4 can be restricted to a predetermined location of the head cap 5.

Next, preliminary discharge of ink from the ink discharge orifices of the print head 4 will be described. Preliminary discharge is ejecting ink within the ink discharge orifices before printing characters or images by suctioning for example, to prevent the ink within the ink discharge orifices from evaporating and drying, which leads to increased viscosity or hardening as described above, which could lead to difficulties in normal ink discharging.

The preliminary discharging of ink is performed toward the ink receptacle 8 of the head cap 5 from the ink discharge orifices, following cleaning the ink discharge face 6 with the cleaning roller 7. For example, ink droplets are discharged from the ink discharge orifices under a frequency of around 10 kHz several times, thus effecting preliminary discharging.

In FIG. 2, there is the need to control the timing of preliminary discharging of ink in the event of performing preliminary discharging of ink following cleaning of the ink discharge face 6 for each of the colors, in order to avoid mixing of the colors by cleaning the ink discharge face 6 of all of the colors with a single cleaning roller 7.

Figure 7:
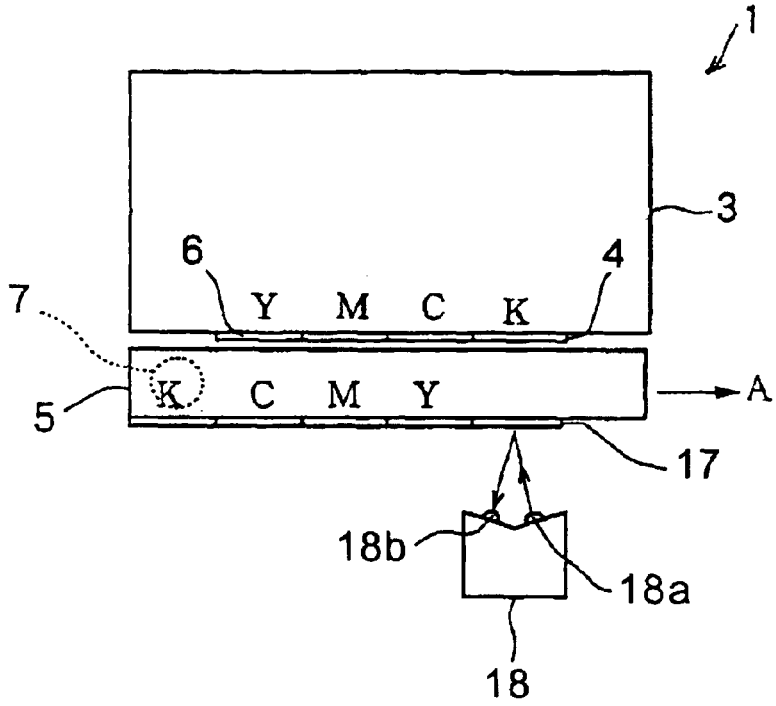
FIG. 7 is an explanatory diagram illustrating means for detecting timing for performing preliminary discharging from ink discharge orifices, which is carried out in the event of the head cap moving relatively to the print head.

Accordingly, as shown in FIG. 7, means are provided to the head cap 5 for detecting the timing of preliminary discharging of ink from the ink discharge orifices of the print head 4 at the time of the head cap 5 moving relative to the print head 4. Note that in FIG. 7, the head cap 5 moves in the opposite direction as compared to FIG. 2.

The means for detecting the timing of the preliminary discharging comprise a position detecting sheet 17 provided on the lower face of the head cap 5, and a photo-electric switch 18 provided within the printer main unit 2 shown in FIG. 1 facing the position detecting sheet 17, as shown in FIG. 7.

The position detecting sheet 17 is for checking the corresponding position with the ink discharge face 6 for each color of the print head 4, at the time of the head cap 5 moving in the direction of the arrow A. For example, patterns of different brightness are formed according to the array pitch of the ink discharge face 6 for the colors Y, M, C, and K, with the array of the pattern being opposite to the direction of the colors Y, M, C, and K, on the ink discharge face 6.

Also, in the initial state of the head cap 5 moving, the pattern array on the side of the position detecting sheet 17 is offset backwards, in the direction of the arrow A.

The photo-optical switch 18 is for detecting the brightness of the position detecting sheet 17 which moves along with the head cap 5, and comprises a light-emitting portion 18*a* of a light-emitting diode (LED) for example, and a photo receptor 18*b* of a photo diode, formed integrally. The pattern of brightness on the position detecting sheet 17 is arranged such that the reflectivity changes according to the wavelength of light emitted from the light-emitting unit 18*a*, and the photo receptor 18*b* is sensitive to the wavelength of the reflected light.

Due to such a configuration, at the time that the head cap 5 moves in the direction of the arrow A, the photo-optical switch 18 detects the position of the position detecting sheet 17 upon the position detecting sheet 17 passing in front of the photo-optical switch 18, so that the position as to the ink discharge face 6 for the colors Y, M, C, and K can be confirmed.

Thus, the timing can be controlled such that preliminary discharge of ink is executed from each of the ink discharge orifices in sequence, immediately after executing cleaning of the ink discharge face 6 for each of the colors by the cleaning roller 7, using the knowledge of the position of the cleaning roller 7 which moves along with the head cap 5. Thus, the ink from the preliminary discharging is received by the ink receptacle 8 in a sure manner.

Figure 8A:
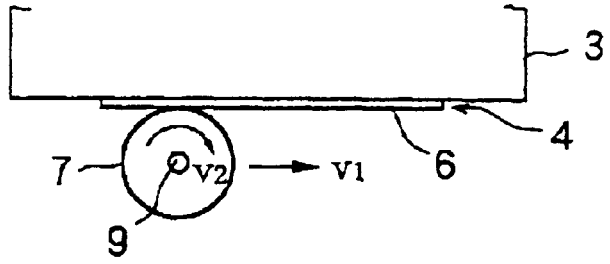
FIGS. 8A and 8B are schematic explanatory diagrams illustrating another embodiment of the cleaning roller.
Figure 8B:
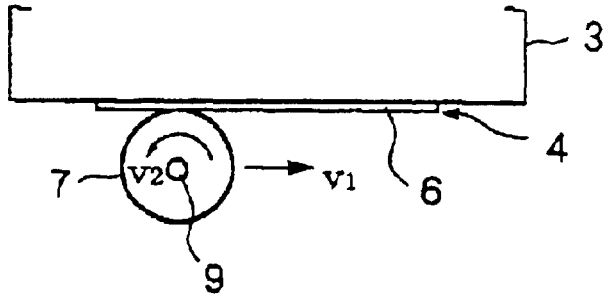

FIGS. 8A and 8B are schematic explanatory diagrams illustrating another embodiment of the cleaning roller 7. With this embodiment, the cleaning roller 7 rotates forwards or backwards by a rotational driving mechanism. That is to say, in the arrangement shown in FIG. 2, the rotating shaft of a motor (not shown) provided within the printer main unit 2 engages the pins 9 of the cleaning roller 7 through a gear arrangement of a suitable gear ratio, so as to actively rotationally drive the cleaning roller 7.

The rotations of the cleaning roller 7 from the motor are in the same direction as the direction of movement of the head cap 5 indicated by the arrow A in FIG. 7, and the cleaning roller 7 is driven so as to rotate with a circumferential speed v2 which is greater than the moving speed v1 of the head cap 5. In this case, rubbing due to the difference in speed between the ink discharge face 6 of the print head 4 and the perimeter of the cleaning roller 7 is generated, so the ink discharge face 6 can be cleaned in a sure manner.

Also, arranging for the moving speed v1 of the head cap 5 to greater than the circumferential speed v2 of the cleaning roller 7 also generates a rubbing force between the ink discharge face 6 of the print head 4 and the perimeter of the cleaning roller 7, so the ink discharge face 6 can be cleaned in a sure manner.

Or, as shown in FIG. 8B, the cleaning roller 7 may be rotated in the opposite direction to the moving direction of the head cap 5 indicated by the arrow A in FIG. 7. On this case, rubbing is generated by the difference in motion between the ink discharge face 6 of the print head 4 and the perimeter of the cleaning roller 7, so the ink discharge face 6 can be cleaned in a sure manner.

Thus, with the embodiment shown in FIG. 8, the ink discharge face 6 of the print head 4 is cleaned by the perimeter face of the cleaning roller 7 continuously delivered thereto by active rotations face of the cleaning roller 7.

Figure 9:
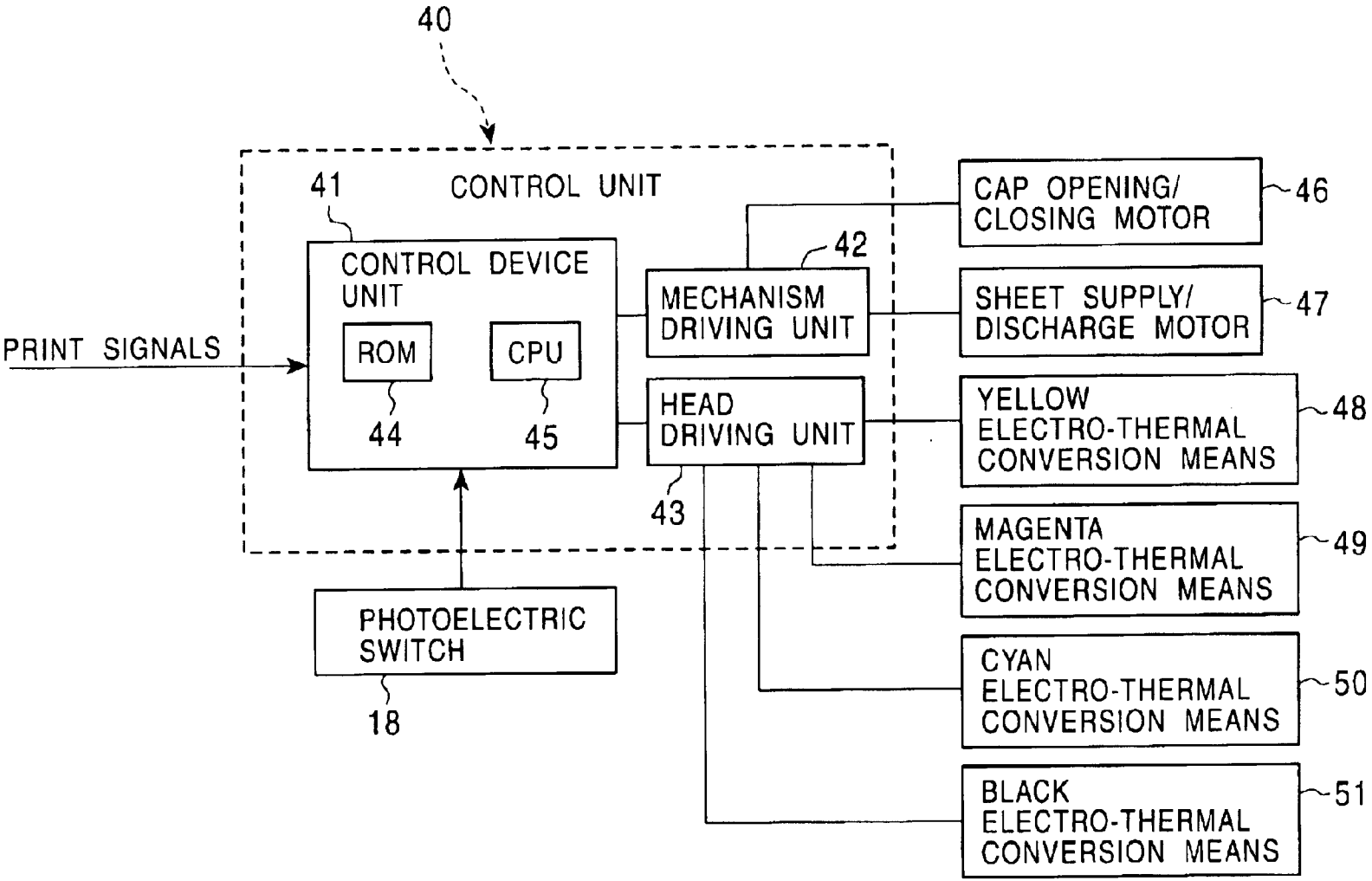
FIG. 9 is a block diagram describing the configuration and operations of a control device for controlling the image formation apparatus.

FIG. 9 is a block diagram describing the configuration and operations of the control device unit 40 for controlling the image formation apparatus configured as described above. This control device unit 40 is for controlling driving of the moving means for moving the head cap 5 in which the cleaning roller 7 is stored, and controlling the ink discharging actions of the ink discharge orifices of the print head 4, and comprises a control unit 41, a mechanism driving unit 42, and a head driving unit 43.

The control unit 41 serves as driving control means for controlling the driving of a later-described cap opening/closing motor 46 for opening and closing the head cap 5, and discharge control means for controlling the ink discharging actions of the ink discharge orifices of the print head 4, and comprises ROM 44 for storing various types of information and control programs therein, and a CPU 45 for sending various types of control commands based on the control programs read from the ROM 44, so as to control the later-described mechanism driving unit 42 and head driving unit 43.

Also, the mechanism driving unit 42 drives the cap opening/closing motor 46 for opening and closing the head cap 5, and a sheet supply/discharge motor 47 for supplying and discharging sheets serving as the recording medium. Note that the cap opening/closing motor 46 serves as the moving means for moving the outer circumference of the cleaning roller 7 and the ink discharge face 6 of the print head 4 relative one to another, with both in contact with each other.

Further, the head driving unit 43 is for driving elements provided to the ink discharge faces 6 of the print head 4, for discharging the ink from the ink discharging orifices provided thereon, for sending driving signals to each of the yellow electro-thermal conversion means 48, magenta electro-thermal conversion means 49, cyan electro-thermal conversion means 50, and black electro-thermal conversion means 51, each configured of heat-generating resistors, for example.

The control device unit 40 configured thus externally acquires print signals indicating the operations for image formation with the control unit 41, inputs detection signals from the photo-electric switch 18 shown in FIG. 7 regarding the position as to the ink discharge faces 6 for each of the colors, sends signals to the mechanism driving unit 42 and the head driving unit 43, and controls preliminary discharge into the head cap 5 in the order of yellow, magenta, cyan, and black, in the order of rows of the ink discharge orifices on the ink discharge faces 6 over which the cleaning roller 7 has passed.

Figure 10:
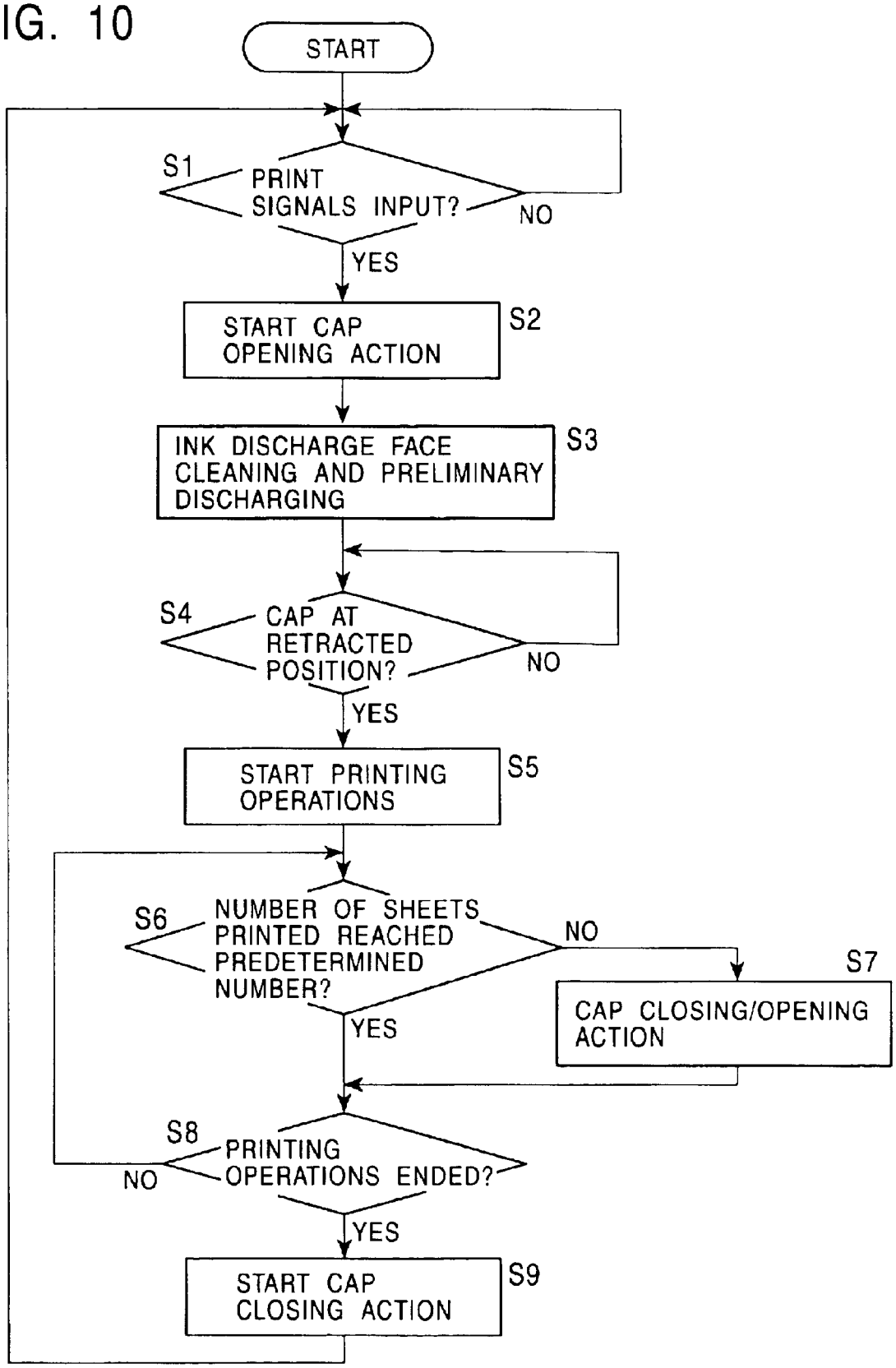
FIG. 10 is a flowchart illustrating a first embodiment of a method for controlling the image formation apparatus according to the present invention, primarily showing control of the print operations.

FIG. 10 is a flowchart illustrating a first embodiment of the control method for the image formation apparatus configured as described above, and primarily shows control of printing operations. Note that the control is executed by commands from the CPU 45, based on the control program stored within the ROM 44 in the control unit 41 shown in FIG. 9.

First, in step S1 in FIG. 10, upon a print signal being input which tells the control unit 41 shown in FIG. 9 to start image formation operations, in step S2 the control unit 41 sends a cap open trigger signal to the mechanism driving unit 42 to drive the cap opening/closing motor 46, thereby starting the opening action of the head cap 5.

Next, in step S3, the cleaning roller 7 cleans the ink discharge face 6 in conjunction with the opening action of the head cap 5, and preliminary discharge of ink is performed by the control unit 41 sending preliminary discharge signals to the head driving unit 43.

Next, in step S4, confirmation is made that the head cap 5 has reached the retracted position, and in step S5, the printing operations are started. Then in step S6, the number of sheets printed is counted by a counter within the control unit 41 that has been omitted in the drawings, and in the event that the count reaches a predetermined number of sheets in step S7, the printing operations are temporarily interrupted, and an action is performed at this time to temporarily close the head cap 5 and then open it again.

At this time, the cleaning and preliminary discharge of the ink discharge face 6 is performed in the same way as with step S3, in conjunction with the opening action of the head cap 5. Upon the cleaning and preliminary discharge of the ink discharge face 6 ending, the counter is reset, and the printing operations are resumed.

In step S8, confirmation is made regarding whether or not the printing operations have ended. In the event that the printing operations have ended, the operating unit 41 sends a cap closing trigger signal to the mechanism driving unit 42 to drive the cap opening/closing motor 46, thereby closing the head cap 5 (step S9), and the flow returns to the initial state in step S1. In the event that the printing operations have not ended in step S8, the flow returns to step S6, and the steps S6 through S8 are repeated until the printing operations end. Subsequently, the above operations are repeated according to input of print signals.

Next, the series of cleaning operations by the cleaning roller 7 and the head cap 5 with the image formation apparatus configured as described above will be described with reference to FIGS. 11A through 11H. Here, with the ink jet head 1 shown in FIG. 2, the head cap 5 moves in the direction indicated by the arrow A, the ink discharge face 6 of the print head 4 is cleaned, and subsequently, preliminary discharge of ink is performed.

Figure 11A:
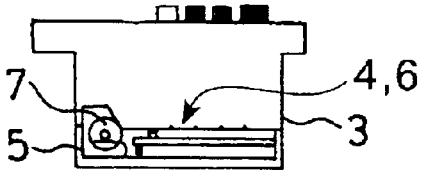
FIGS. 11A through 11H are explanatory diagrams describing the cleaning actions of a head cap of an ink jet head and a cleaning roller.
Figure 11B:
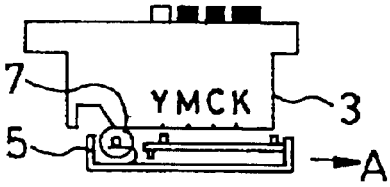

First, 11A illustrates an initial state wherein the head cap 5 is closed as to the ink cartridge 3. The ink jet head 1 is stored in the printer main unit 2 as shown in FIG. 1, in this state. Next, in the state of the ink jet head 1 having been stored in the printer main unit 2, the head cap 5 is moved in the direction indicated by the arrow A relative as to the ink cartridge 3, as indicated in FIG. 11B, due to a head cap open signal.

The head cap 5 then moves in the direction indicated by the arrow A as to the ink cartridge 3, and the cleaning roller 7 is rotated in the state of being pressed against the ink discharge face 6 of the print head 4, or rotates with the rotations restricted by the braking mechanism or stationary due to having been fixed, or rotates by being driven by a motor in the forward or reverse direction; and in any of these cases, the cleaning roller 7 moves over the ink discharge face 6 of the print head 4 in contact therewith, regardless of the direction or speed or presence/absence of rotations.

In this state, let us say that the yellow ink discharge face 6, of the ink discharge faces 6 of the print head 4 shown in FIG. 2, has been cleaned. The position detecting sheet 17 (see FIG. 7) provided on the lower face of the head cap 5 moves to the detection position of the photo-electric switch 18 corresponding to the yellow color, and detection is made that the cleaning of the ink discharge face 6 of the yellow color has been completed. Accordingly, the control unit 41 shown in FIG. 9 sends a preliminary discharge start signal to the head driving unit 43. That is to say, a preliminary discharge start signal is sent to the row of ink discharge orifices of the discharge face 6 for the yellow color (the yellow electro-thermal conversion means 48).

Figure 11C:
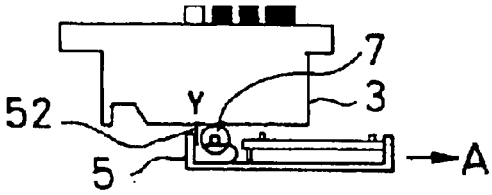

Next, as shown in FIG. 11C, preliminary discharge ink 52 is jettisoned from the ink discharge orifices of the ink discharge face 6 for the yellow color. Subsequently, a preliminary discharge stop signal is sent to the row of ink discharge orifices of the ink discharge face 6 for the yellow color, and jettisoning of the preliminary discharge ink 52 is stopped. Then, following ending of cleaning of the ink discharge faces 6 for each of M, C, and K with the cleaning roller 7 in FIG. 2, the photo-electric switch 18 detects ending of the cleaning of that ink discharge face 6, and a preliminary discharge start signal and a preliminary discharge stop signal is sent from the control unit 41 to the row of ink discharge orifices.

Figure 11D:
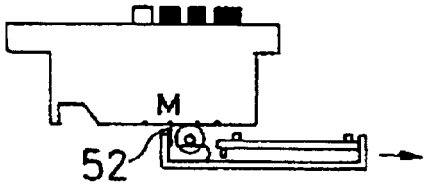
Figure 11E:
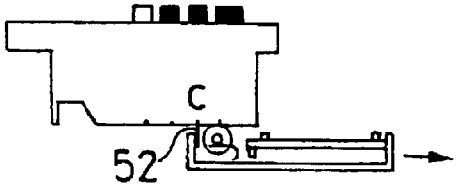
Figure 11F:
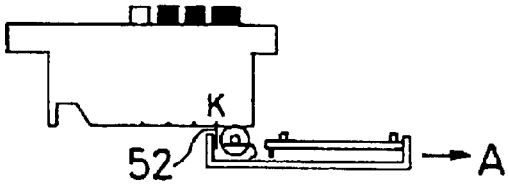

Thus, as shown in FIGS. 11D through 11F, preliminary discharge ink 52 is sequentially jettisoned in the order of M, C, and K, with the timing of preliminary discharge from the rows of ink discharge orifices for each color being controlled.

Figure 11G:
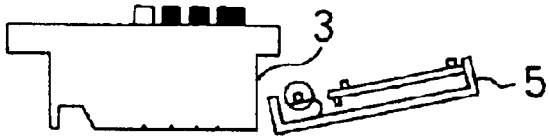

Upon the cleaning of the ink discharge face 6 for each color and the preliminary discharging ending as shown in FIG. 11G, the head cap 5 moves all the way in the direction of the arrow A, moves somewhat upwards, and rests at a retracted position. Printing of characters and images is performed in this state.

Figure 11H:
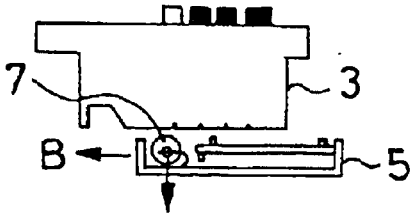

Next, following image formation for a predetermined number of sheets ending, a head cap closing signal is sent, the head cap 5 moves in the direction of the arrow B relative to the ink cartridge 3, and temporarily enters a closed state such as shown in FIG. 11H from the retracted position. Immediately following this, a head cap opening signal is received, and the head cap 5 opens and returns to the retracted state shown in FIG. 11G. At this time, the cleaning roller 7 also relatively moves as to the ink cartridge 3, in conjunction with the opening/closing action of the head cap 5.

At this time, in conjunction with the opening/closing action of the head cap 5, the cleaning roller 7 cleans the ink discharge face 6 of the print head 4 by relatively moving in the state of the outer circumference thereof being in contact therewith, and preliminary discharge is performed for the ink discharge orifices. In this case, the cleaning roller 7 is not in contact with the ink discharge face 6 when the head cap 5 is returning in the direction indicated by the arrow B, nor is the ink discharge face 6 cleaned.

This operations is repeated, and upon the printing operations ending, the head cap 5 returns to the initial state of being closed to the ink cartridge 3, and awaits subsequent commands for printing characters or images.

Now, while description of the interruption of printing operations made with reference to FIGS. 11A through 11H was made regarding an arrangement wherein the cleaning roller 7 comes into contact with the ink discharge face 6 at the time of the head cap 5 moving in the direction of the arrow A so as to clean the ink discharge face 6, following which preliminary discharge of ink is performed, and the cleaning roller 7 does not come into contact with the ink discharge face 6 at the time of the head cap 5 returning in the direction indicated by the arrow B, but the present invention is not restricted to this arrangement, and there may be cases wherein preliminary discharge of ink is not performed, with only cleaning of the ink discharge face 6 by the cleaning roller 7 being performed.

Also, there may be cases wherein the head cap 5 moves in the directions indicated by the arrows A and B, without the cleaning head 7 in contact with the ink discharge face 6. In this case, the ink discharge face 6 is not cleaned with the cleaning roller 7, and only preliminary discharge of ink is performed into the head cap 5.

At this time, there also is a sequence wherein preliminary discharge of ink is performed at the point of the head cap 5 returning from the retracted position shown in FIG. 11G to the position shown in FIG. 11H, following which the head cap 5 returns to the position in FIG. 11G again.

Also, there may be cases wherein preliminary discharge of ink is performed regardless of the opening/closing actions of the head cap 5 at the retracted position shown in FIG.

11G, and accordingly cleaning of the ink discharge face 6 by the cleaning roller 7 is not performed.

Though description has been made with reference to FIG. 10 and FIGS. 11A through 11H regarding an arrangement wherein the ink discharge face 6 is cleaned at the time of the head cap 5 moving in the direction indicated by the arrow A, following which preliminary discharge of ink is performed, but a reverse arrangement may also be made wherein the ink discharge face 6 is cleaned with the cleaning roller 7 at the time of closing the head cap 5, following which preliminary discharge of ink is performed. The following is a description of such an arrangement.

Figure 12:
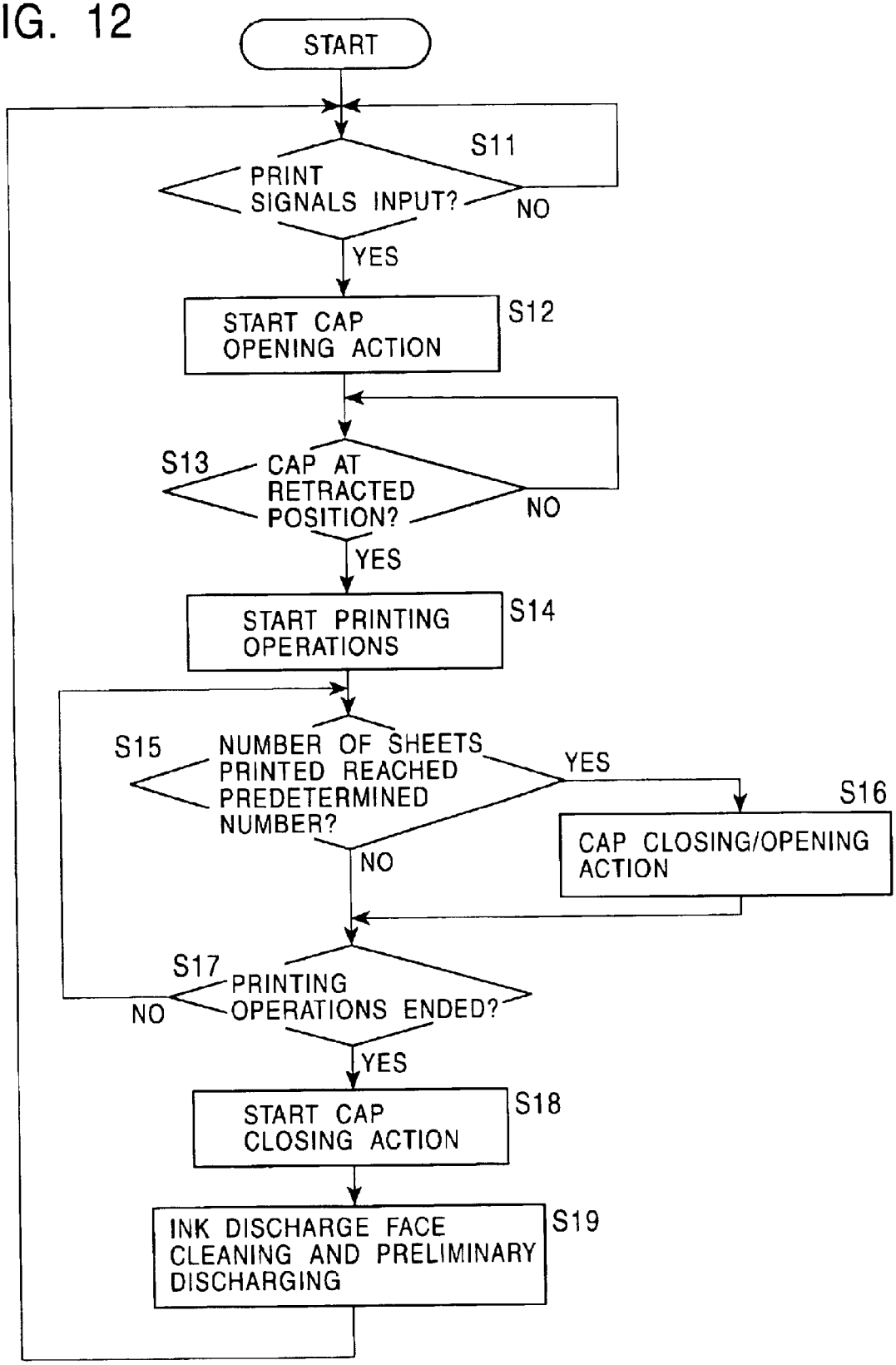
FIG. 12 is a flowchart illustrating a second embodiment of a method for controlling the image formation apparatus according to the present invention, primarily showing control of the print operations.

FIG. 12 is a flowchart illustrating a second embodiment of the control method for the image formation apparatus according to the present invention, and primarily shows control of printing operations wherein cleaning of the ink discharge face 6 and preliminary discharge of ink is performed in conjunction with the closing action of the head cap 5. Note that the control is executed by commands from the CPU 45, based on the control program stored within the ROM 44 in the control unit 41 shown in FIG. 9 with this arrangement as well.

First, in step S11 in FIG. 12, upon a print signal being input which tells the control unit 41 shown in FIG. 9 to start image formation operations, in step S12 the control unit 41 sends a cap open trigger signal to the mechanism driving unit 42 to drive the cap opening/closing motor 46, thereby starting the opening action of the head cap 5.

Next, in step S13, confirmation is made that the head cap 5 has reached the retracted position, and in step S14, the printing operations are started. Then in step S15, the number of sheets printed is counted by a counter within the control unit 41 that has been omitted in the drawings, and in the event that the count reaches a predetermined number of sheets, the printing operations are temporarily interrupted in step S16, and an action is performed at this time to temporarily close the head cap 5 and then open it again.

At this time, the cleaning and preliminary discharge of the ink discharge face 6 is performed in conjunction with the closing action of the head cap 5, and preliminary discharge of ink is performed by the control unit 41 sending a preliminary discharge signal to the head driving unit 43. Upon the cleaning and preliminary discharge of the ink discharge face 6 ending, the counter is reset, and the printing operations are resumed.

In step S17, confirmation is made regarding whether or not the printing operations have ended. In the event that the printing operations have ended, the operating unit 41 sends a cap closing trigger signal to the mechanism driving unit 42 to drive the cap opening/closing motor 46, thereby starting the closing action of the head cap 5 (step S18), and in step S19, cleaning of the ink discharge face 6 and preliminary discharge of ink is performed. Then, the flow returns to the initial state in step S11. In the event that the printing operations have not ended in step S17, the flow returns to step S15, and the steps S15 through S17 are repeated until the printing operations end. Subsequently, the above operations are repeated according to input of print signals.

In this case as well, an arrangement may be made wherein only cleaning of the ink discharge face 6 by the cleaning roller 7 is performed without preliminary discharge of ink being performed, or an opposite arrangement wherein only preliminary discharge of ink is performed without cleaning of the ink discharge face 6 by the cleaning roller 7 being performed.

Also, an arrangement may be made wherein, as with FIG. 10 and FIGS. 11A through 11H, cleaning of the ink discharge face 6 is performed at the time of the head cap 5 moving in the direction indicated by the arrow A, following which preliminary discharge of ink is performed, and also temporarily interrupting the printing operations in the event that a predetermined amount of time elapses following starting of printing operations, and cleaning of the ink discharge face 6 and preliminary discharge are performed in conjunction with the operations of opening the head cap 5. This will now be described.

Figure 13:
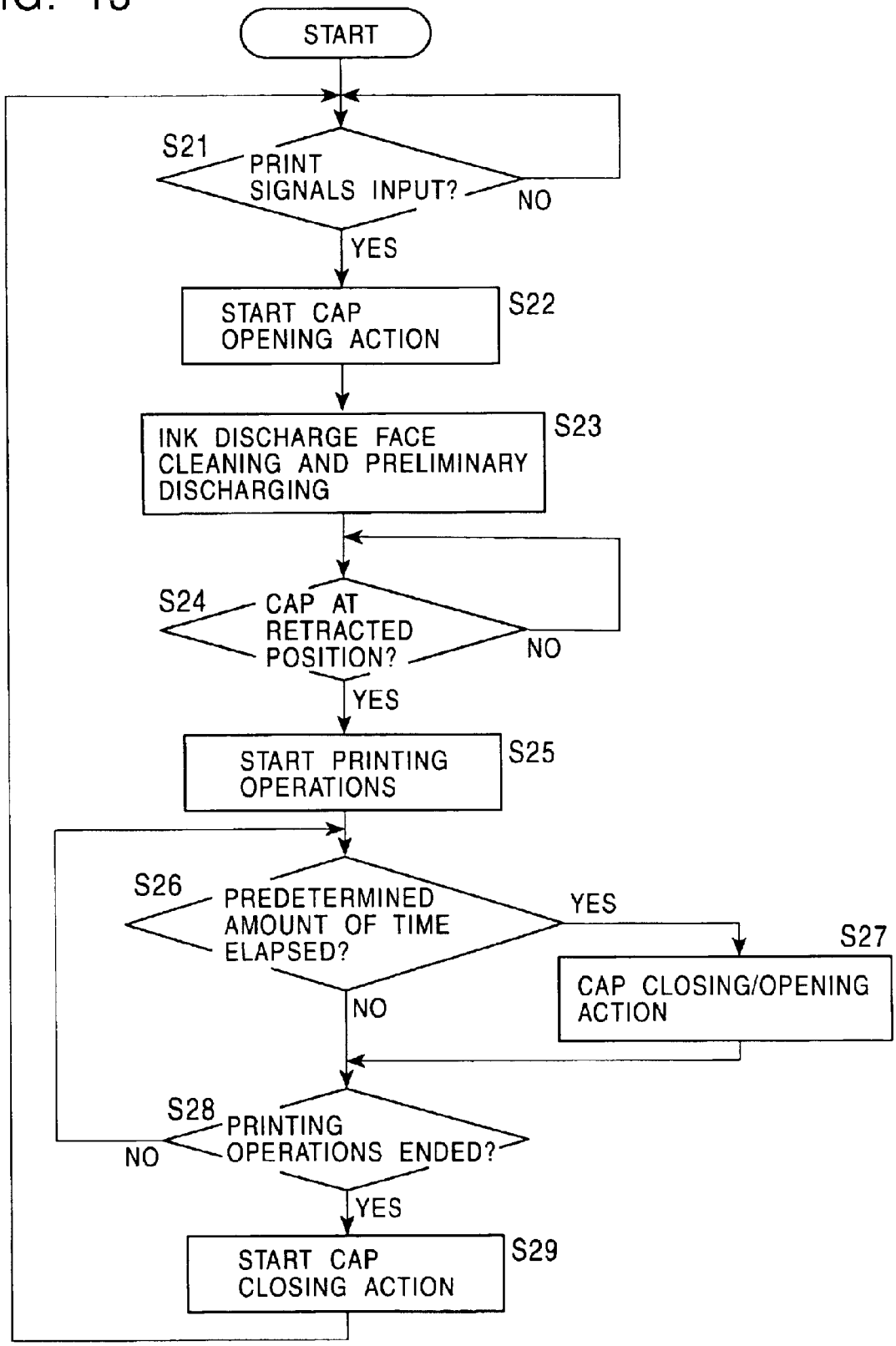
FIG. 13 is a flowchart illustrating a third embodiment of a method for controlling the image formation apparatus according to the present invention, primarily showing control of the print operations.

FIG. 13 is a flowchart illustrating a third embodiment of the control method for the image formation apparatus according to the present invention, and primarily shows control of printing operations. In this case as well, control is executed by commands from the CPU 45, based on the control program stored within the ROM 44 in the control unit 41 shown in FIG. 9.

First, in step S21 in FIG. 13, upon a print signal being input which tells the control unit 41 shown in FIG. 9 to start image formation operations, in step S22 the control unit 41 sends a cap open trigger signal to the mechanism driving unit 42 to drive the cap opening/closing motor 46, thereby starting the opening action of the head cap 5.

Next, in step S23, the cleaning roller 7 cleans the ink discharge face 6 in conjunction with the opening action of the head cap 5, and preliminary discharge of ink is performed by the control unit 41 sending preliminary discharge signals to the head driving unit 43.

Next, in step S24, confirmation is made that the head cap 5 has reached the retracted position, and in step S25, the printing operations are started. Then in step S26, the amount of time from the starting of printing operations is counted by a timer within the control unit 41 that has been omitted in the drawings, and after a predetermined amount of time elapses, in step S27, the printing operations are temporarily interrupted, and an action is performed at this time to temporarily close the head cap 5 and then open it again. At this time, the cleaning and preliminary discharge of the ink discharge face 6 is performed in the same way as with step S23, in conjunction with the opening action of the head cap 5. Upon the cleaning and preliminary discharge of the ink discharge face 6 ending, the timer is reset, and the printing operations are resumed.

In step S28, confirmation is made regarding whether or not the printing operations have ended. In the event that the printing operations have ended, the control unit 41 sends a cap closing trigger signal to the mechanism driving unit 42 to drive the cap opening/closing motor 46, thereby closing the head cap 5 (step S29), and the flow returns to the initial state in step S21. In the event that the printing operations have not ended in step S28, the flow returns to step S26, and the steps S26 through S28 are repeated until the printing operations end. Subsequently, the above operations are repeated according to input of print signals.

In this case as well, an arrangement may be made wherein only cleaning of the ink discharge face 6 by the cleaning roller 7 is performed without preliminary discharge of ink being performed, or an opposite arrangement wherein only preliminary discharge of ink is performed without cleaning of the ink discharge face 6 by the cleaning roller 7 being performed.

Though description has been made with reference to FIG. 13 regarding an arrangement wherein the ink discharge face 6 is cleaned at the time of the head cap 5 moving in the direction indicated by the arrow A, following which preliminary discharge of ink is performed, but a reverse arrangement may also be made wherein the head cap 5 moves in the direction indicated by the arrow A without cleaning the discharge face 6, with the ink discharge face 6 being cleaned with the cleaning roller 7 at the time of closing the head cap 5 in the direction indicated by the arrow B, following which preliminary discharge of ink is performed. The following is a description of such an arrangement.

Figure 14:
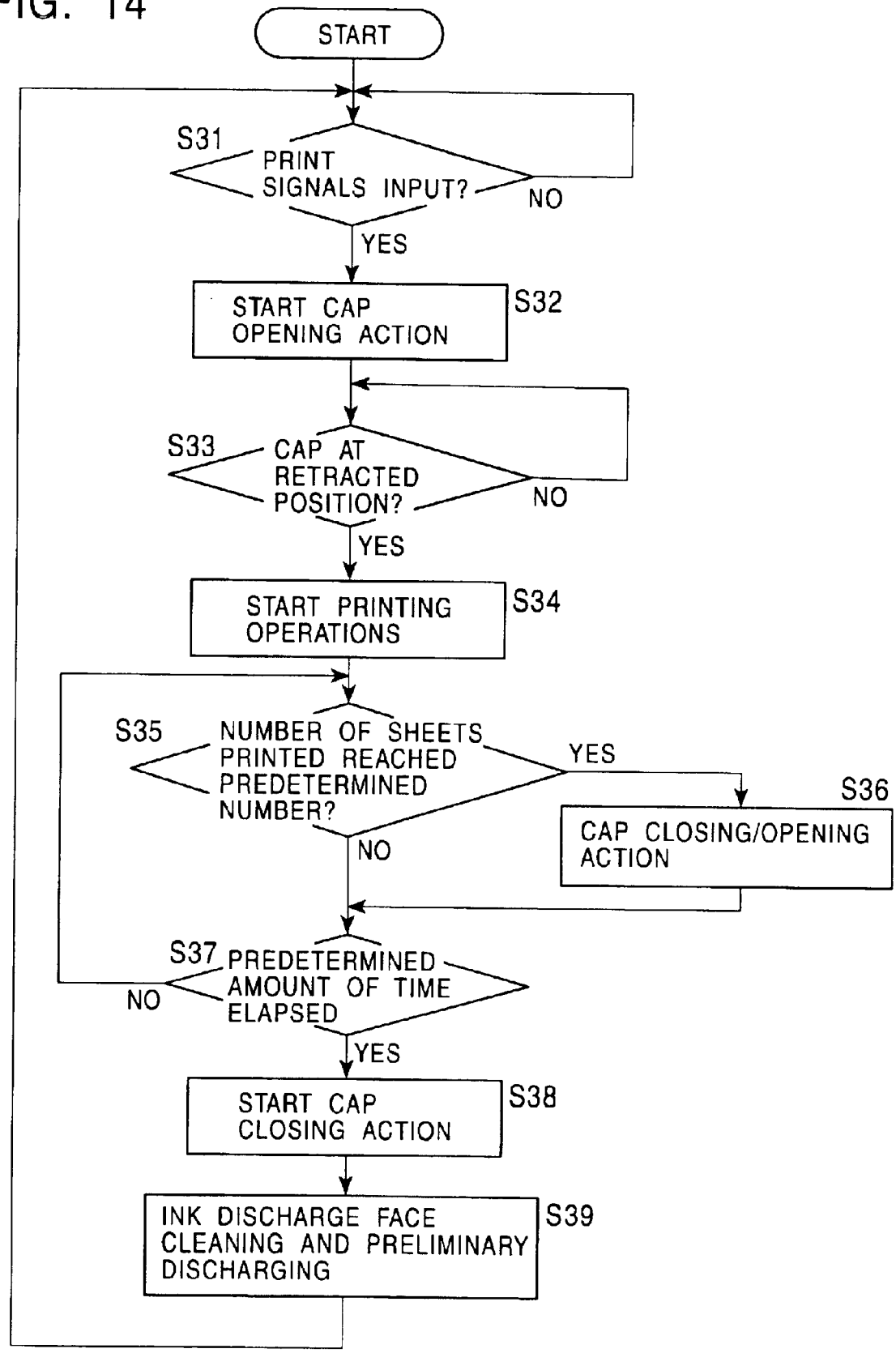
FIG. 14 is a flowchart illustrating a fourth embodiment of a method for controlling the image formation apparatus according to the present invention, primarily showing control of the print operations.

FIG. 14 is a flowchart illustrating a fourth embodiment of the control method for the image formation apparatus according to the present invention, and primarily shows control of printing operations wherein cleaning of the ink discharge face 6 and preliminary discharge of ink is performed in conjunction with the operations of temporarily interrupting printing operations each time a predetermined amount of time elapses following starting of the printing operations, temporarily closing the head cap 5 and then reopening it, and then closing the head cap 5. Note that the control is executed by commands from the CPU 45, based on the control program stored within the ROM 44 in the control unit 41 shown in FIG. 9 with this arrangement as well.

First, in step S31 in FIG. 14, upon a print signal being input which tells the control unit 41 shown in FIG. 9 to start image formation operations, in step S32 the control unit 41 sends a cap open trigger signal to the mechanism driving unit 42 to drive the cap opening/closing motor 46, thereby starting the opening action of the head cap 5.

Next, in step S33, confirmation is made that the head cap 5 has reached the retracted position, and in step S34, the printing operations are started. Then in step S35, the amount of time from the starting of printing operations is counted by a timer within the control unit 41 that has been omitted in the drawings, and in the event that after a predetermined amount of time elapses, the printing operations are temporarily interrupted in step S36, and an action is performed at this time to temporarily close the head cap 5 and then open it again.

At this time, the cleaning of the ink discharge face 6 by he cleaning roller 7 is performed in conjunction with the closing action of the head cap 5, and preliminary discharge of ink is performed by the control unit 41 sending a preliminary discharge signal to the head driving unit 43. Upon the cleaning and preliminary discharge of the ink discharge face 6 ending, the timer is reset, and the printing operations are resumed.

In step S37, confirmation is made regarding whether or not the printing operations have ended. In the event that the printing operations have ended, the control unit 41 sends a cap closing trigger signal to the mechanism driving unit 42 to drive the cap opening/closing motor 46, thereby starting the closing action of the head cap 5 (step S38), and in step S39, cleaning of the ink discharge face 6 and preliminary discharge of ink is performed. Then, the flow returns to the initial state in step S31. In the event that the printing operations have not ended in step S37, the flow returns to step S35, and the steps S35 through S37 are repeated until the printing operations end. Subsequently, the above operations are repeated according to input of print signals.

In this case as well, an arrangement may be made wherein only cleaning of the ink discharge face 6 by the cleaning roller 7 is performed without preliminary discharge of ink being performed, or an opposite arrangement wherein only preliminary discharge of ink is performed without cleaning of the ink discharge face 6 by the cleaning roller 7 being performed.

Next, the overall configuration and operations of the image formation apparatus described above, which is an ink jet printer, will be described with reference to FIG. 1 and FIGS. 15 through 21. This ink jet printer discharges ink from the ink jet head as fine particles onto recording sheets so as to carry out printing, and as shown in FIG. 1, comprises the ink jet head 1, printer main unit 2, head mounting/detaching mechanism 19, and head cap opening/closing mechanism 20. The ink jet printer shown is of a type wherein an ink jet head 1 is directly mounted to the printer main unit 2.

The ink jet head 1 discharges liquid ink by forming fine particles of the liquid ink using electro-thermal conversion or electromechanical conversion for example, and sprays the ink onto a recording medium such as recording paper, and is configured as already described with reference to FIGS. 1 through 11H.

The printer main unit 2 is for mounting the ink jet head 1 at a predetermined position so as to function as an ink jet printer, and comprises a recording sheet tray, recording sheet transporting system, action driving system, overall control circuit unit, and so forth. Note that the reference numeral 21 in FIG. 1 denotes a sheet supply cartridge for supplying recording sheets and a discharged sheet tray for receiving sheets discharged following printing.

The head mounting/detaching mechanism 19 is for fixing the ink jet head 1 to the predetermined position on the printer main unit 2 and to disengage the fixing thereof, and comprises a bar member which is long sideways, configured such that the ink jet head 1 is inserted into a predetermined position formed of a recess provided on the center portion of the printer main unit 2 for example, with the top face of the ink jet head 1 then being pressed down by the bar member.

This bar member extends over the entire width direction of the printer main unit 2, and is arranged so as to be raised vertically or to be laid down horizontally. The ink jet head 1 is stored in the recess on the printer main unit 2 in the direction indicated by the arrow H, in the state of the bar member being vertically erected as shown in FIG. 1, and the ink jet head 1 is then fixed to this predetermined position by the bar member being laid down horizontally as shown in FIG. 15.

The head cap opening/closing mechanism 20 moves the head cap 5 relatively as to the print head 4 (see FIG. 2) in the state that the ink jet head 1 is fixed at the predetermined position on the printer main unit 2 so as to release the ink discharge face 6 (see FIG. 2), and also closes the head cap 5 following completion of printing. The head cap opening/closing mechanism 20 operates by a rack 22 provided to the side of the printer main unit 2 and a pinion 23 meshing. Pin-shaped protrusions are erected on the inner side of the rack 22, which fit into recesses formed on the outer side face corresponding to the head cap 5.

Figure 15:
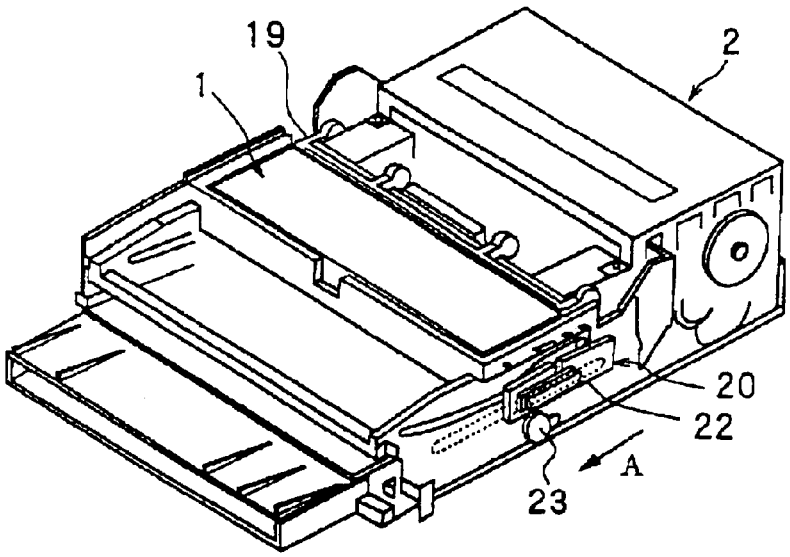
FIG. 15 is a perspective view illustrating an embodiment of an ink jet printer as an example of the image formation device according to the present invention, showing the ink jet head mounted.
Figure 16:
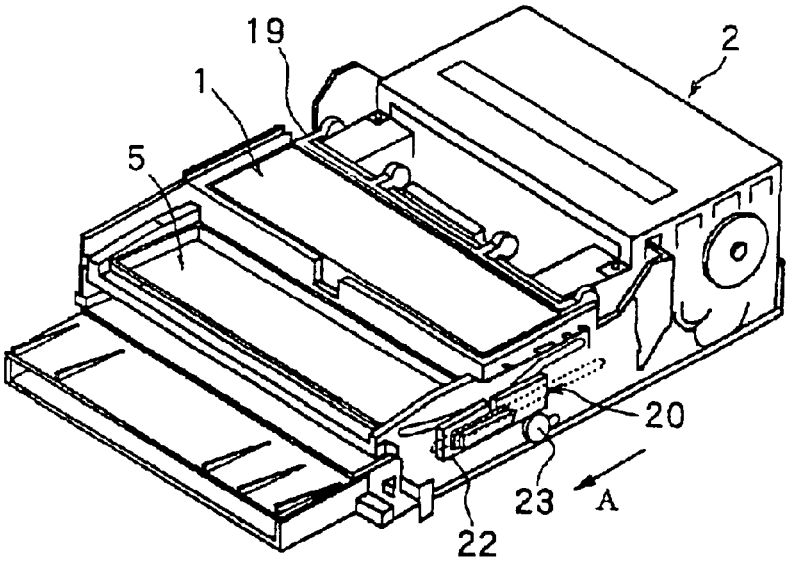
FIG. 16 is another perspective view illustrating an embodiment of the ink jet printer, showing the head cap opened.

Further, as shown in FIG. 15, in the state that the ink jet head 1 has been fixed to the predetermined position of the printer main unit 2 with the head mounting/detaching mechanism 19, rotating the pinion 23 in a predetermined direction with a motor which is omitted in the drawings moves the rack 22 in the direction indicated by the arrow A as shown in FIG. 16, which also moves the head cap 5 shown in FIG. 1 in the direction indicated by the arrow A, so as to be stored in the retracted position.

Note that the head cap opening/closing mechanism 20 is not restricted to an arrangement such as described above therein the rack 22 and pinion 23 mesh, and may rather be an arrangement wherein rubber rollers for example are pressed against both side faces of the head cap 5 with the rubber rollers being driven by a motor through a driving shaft, so as to move the head cap 5 in the direction indicated by the arrow A by friction between the head cap 5 and the rubber rollers.

Next, a specific mechanism and actions for fixing the ink jet head 1 to the predetermined position of the printer main unit 2 shown in FIG. 1 and moving the head cap 5 relative to the print head 4 (see FIG. 2) so as to release the ink discharge face 6 (see FIG. 2) will be described with reference to FIGS. 17 through 21.

Figure 17:
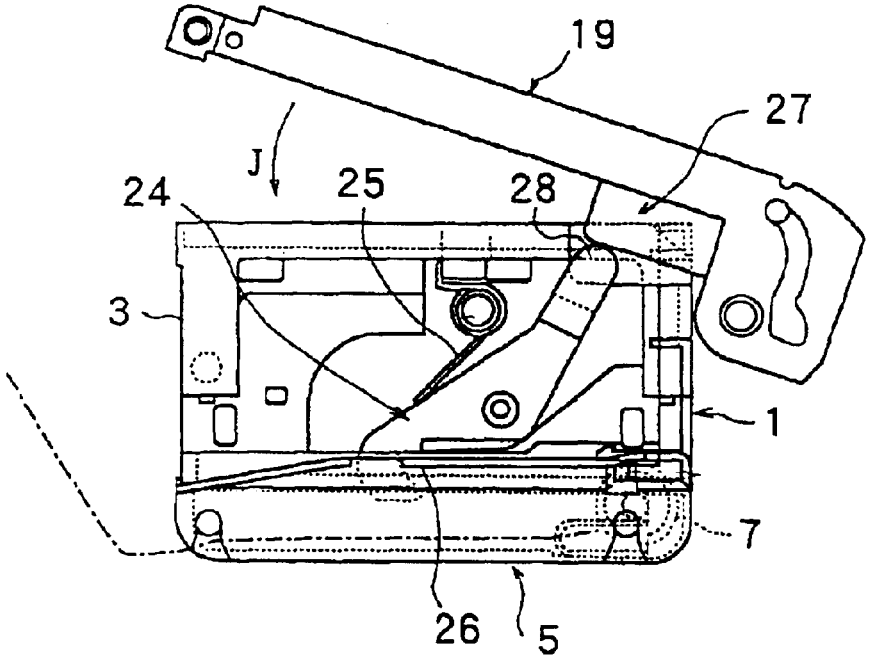
FIG. 17 is an explanatory diagram illustrating a specific mechanism and actions for inserting and storing the ink jet head shown in FIG. 1 into a predetermined location in the printer main unit in the direction of the arrow H.
Figure 18:
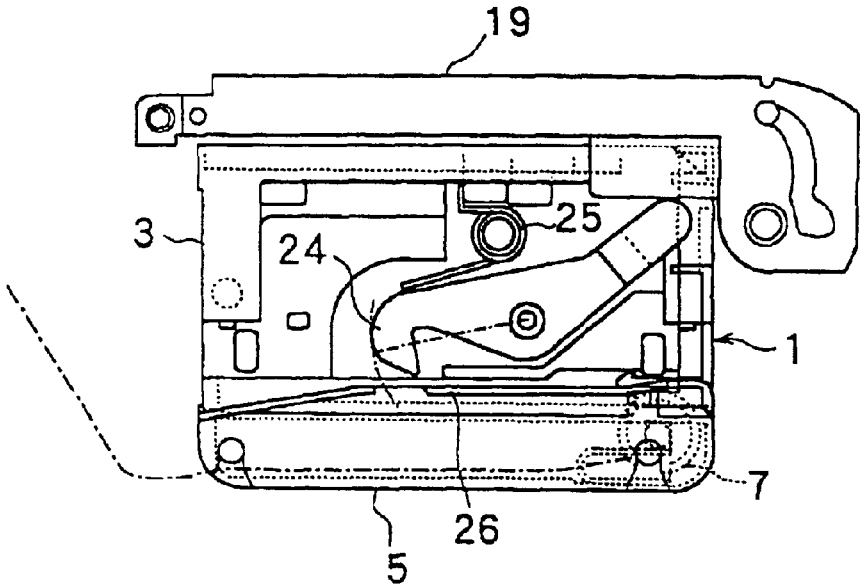
FIG. 18 is an explanatory diagram illustrating a specific mechanism and actions of the ink jet head being fixed at a predetermined location of the printer main unit by a head mounting/detaching mechanism, wherein the head cap is movable.

First, FIG. 17 illustrates the state of the ink jet head 1 shown in FIG. 1 having been inserted into the predetermined position of the printer main unit 2 in the direction indicated by the arrow H and stored. In this state, the lower end portion of cap lock hooks 24 provided on both sides of the ink jet head 1 engage retaining pieces 26 on both sides of the head cap 5 with the elastic force of helix springs 25. Thus, the head cap 5 is integrally mounted to the ink cartridge 3.

In this state, the head mounting/detaching mechanism 19 is pressed down in the direction indicated by the arrow J in FIG. 17 so as to be fixed. This depresses and rotates an upper portion 28 of the cap lock hooks 24 with cap lock disengaging pieces 27 provided on the lower side of the head mounting/detaching mechanism 19, and as shown in FIG. 17, raises the lower portion of the cap lock hooks 24 so as to disengage the engagement with retaining pieces 26 on both sides of the head cap 5. Thus, as shown in FIG. 15, the ink jet head 1 is fixed at the predetermined position on the printer main unit 2 by the head mounting/detaching mechanism 19, and also the head cap 5 is now capable of moving.

Figure 19:
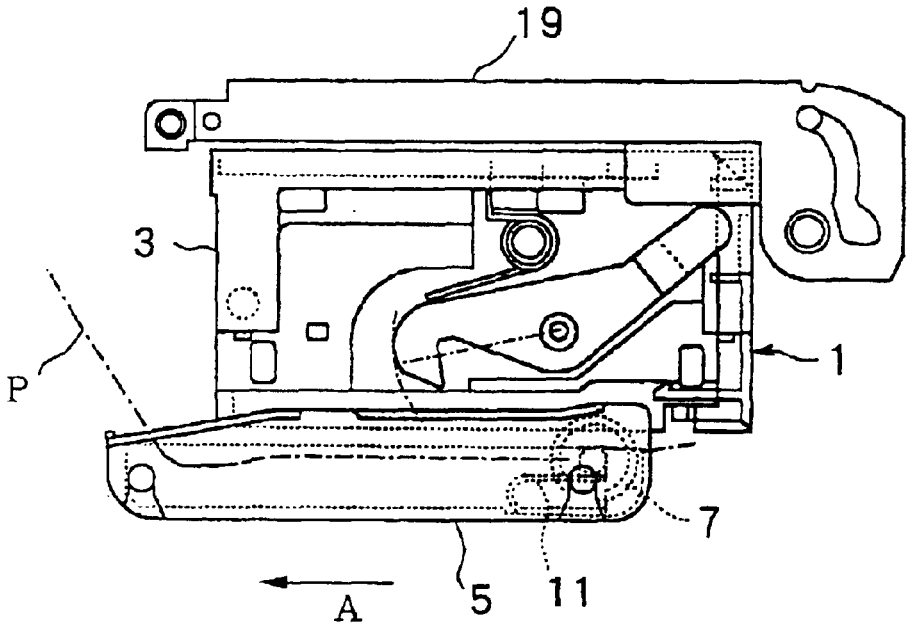
FIG. 19 is an explanatory diagram illustrating a specific mechanism and actions of the head cap mounted on the bottom side of the ink cartridge moving in the direction of the arrow A and opening.

Next, the head cap opening/closing mechanism 20 shown in FIG. 15 is operated to rotate the pinion 23 by rotations of the unshown motor such that the rack 22 moves in the direction indicated by the arrow A. This causes the head cap 5 mounted on the base side of the ink cartridge 3 to move in the direction indicated by the arrow A along with the rack 22 as shown in FIG. 19. Cleaning of the ink discharge face 6 of the print head 4 provided on the bottom of the ink cartridge 3 as shown in FIG. 2 is then started using the cleaning roller 7 pressed against the ink discharge face 6 with the floating spring 11. Note that the reference symbol P in FIG. 19 indicates the track of movement of the head cap 5.

Figure 20:
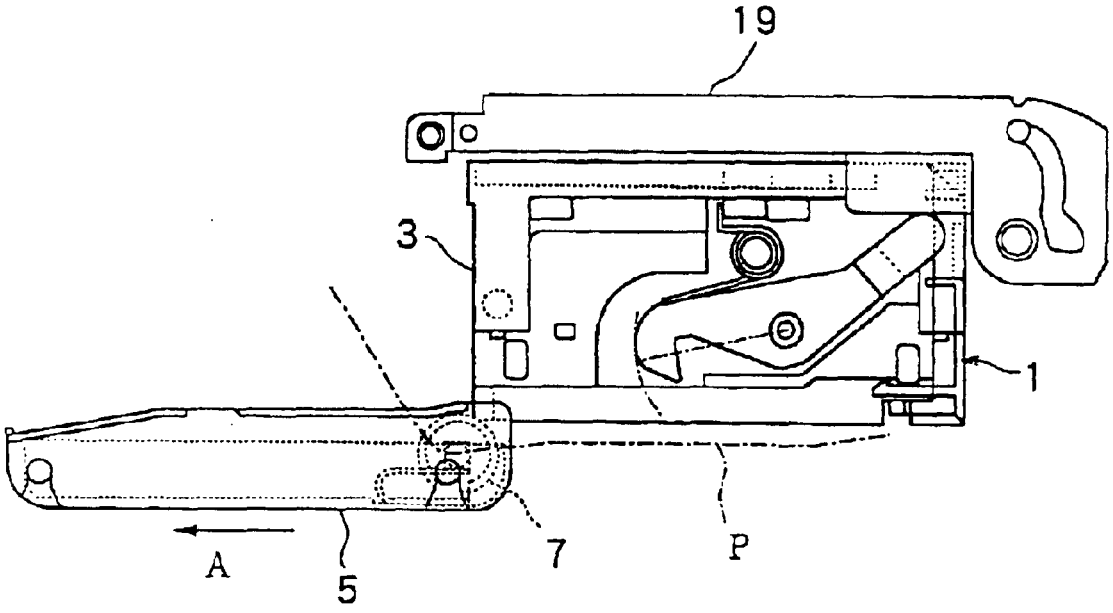
FIG. 20 is an explanatory diagram illustrating a specific mechanism and actions of the head cap sequentially moving in the direction of the arrow A following the track of movement P.

Subsequently, as shown in FIG. 20, the head cap 5 continues to move in the direction indicated by the arrow A over the movement track P. At this time, the cleaning roller 7 attached to the head cap 5 sequentially cleans the ink discharge faces 6 for the colors Y, M, C, and K, shown in FIG. 2, following which preliminary discharge of ink is performed.

Figure 21:
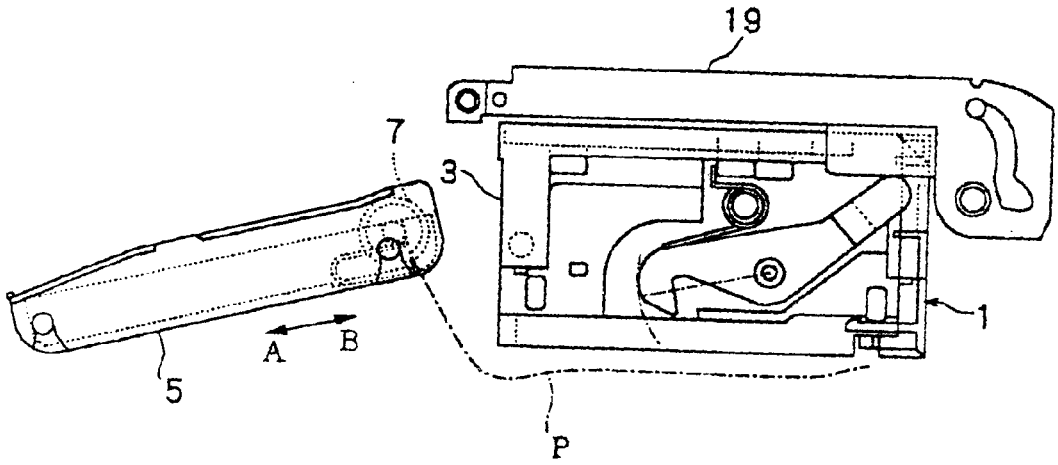
FIG. 21 is an explanatory diagram illustrating a specific mechanism and actions of the head cap moved all the way in the direction of the arrow A following the track of movement P, to reach a retracted position.

Upon the ink discharge faces 6 of each of the colors being cleaned and preliminary discharging ending, the head cap 5 moves all the way in the direction of the arrow A over the movement track P, moves somewhat upwards as shown in FIG. 21, and rests at a retracted position, as shown in FIG. 16. Printing of characters and images is performed in this state. Moving the head cap 5 somewhat upwards as shown in FIG. 21 enables the space required for storing to be reduced.

Now, recording sheets pass below the print head 4 provided on the bottom of the ink cartridge 3 in FIG. 21, and an arrangement may be made wherein passage of the recording sheet is guided at the lower face of the head cap 5. In this case, the lower face side of the head cap 5 may comprise ribs for guiding the recording sheets. Further, the head cap 5 may be treated so as to be water-repellent, to prevent ink on the recording sheets from adhering thereto.

Upon printing operations ending in this state, the head cap 5 moves from the retracted position shown in FIG. 21 in the direction indicated by the arrow B by operations reverse to those described above, and as shown in FIG. 18, the head cap 5 reaches the initial state at the bottom side of the ink cartridge 3.

Also, each time a predetermined number of sheets are printed or each time a certain amount of time elapses following starting the printing operations, operations are performed for temporarily moving the head cap 5 in the direction indicated by the arrow B in FIG. 21 to close the head cap 5 and then reopen it by moving in the direction indicated by the arrow A all the way to the retracted position. At this time, the ink discharge face 6 is cleaned and preliminary discharging is performed.

In FIG. 17, opening the head mounting/detaching mechanism 19 in the direction opposite to the arrow J engaging the cap lock hooks 24 to the retaining pieces 26 on both sides of the head cap 5 by the elastic force of the helix spring 25 so that the head cap 5 is integrally mounted to the ink cartridge 3. In this state, the ink jet head 1 can be removed from the printer main unit 2.

Now, in the event that the electric power source of the printer is cut off for some reason in the state that the head cap 5 is in the retracted position shown in FIG. 21, the head cap 5 remains at the retracted position. In the event that the head mounting/detaching mechanism 19 is opened in the direction opposite to the arrow J as shown in FIG. 17, the ink cartridge 3 would be removed without the head cap 5, since the head cap 5 would remain at the retracted position.

Accordingly, in order to prevent such a situation, an interlocking mechanism may be provided wherein, in the event that the electric power source of the printer is cut off for some reason, the head cap 5 at the retracted position automatically returns to the initial state shown in FIG. 17, or wherein opening the head mounting/detaching mechanism 19 in the direction opposite to the arrow J is disabled as long as the head cap 5 has not returned to the initial state shown in FIG. 17.

Thus, according to the image formation apparatus of the present invention, each time a predetermined number of sheets are printed or each time a certain amount of time elapses following starting the printing operations, the printing operations are temporarily interrupted, the head cap 5 is temporarily closed and then reopened, and in conjunction with the opening action of the head cap 5 or the closing action thereof, the cylindrical cleaning roller 7 formed of an elastic material is moved over the ink discharge face 6 so as to suction the ink within the ink discharging orifices, following which preliminary discharge from the ink discharging orifices is performed, thereby improving the effects of cleaning around the ink discharging orifices without damaging the ink discharge face 6. Also, the effects of cleaning around the ink discharging orifices can be improved when executing print jobs with a great number of pages or consecutively executing many print jobs.

Now, the ink jet printer described with reference to FIG. 1 and FIGS. 15 through 21 is a type wherein the ink jet head 1 is directly mounted to the printer main unit 2, but the present invention is not restricted to this, and may be similarly applied to types wherein the ink jet head 1 is mounted to the printer main unit 2 by a tray. The following is a generally description of ink jet printers of such other types, with reference to FIGS. 22A and 22B.

Figure 22A:
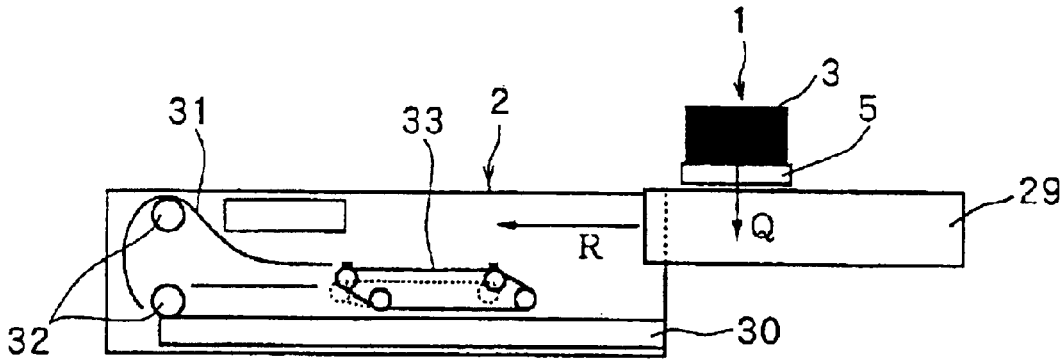
FIGS. 22A and 22B are schematic explanatory diagrams illustrating an ink jet printer of a different type wherein the ink jet head is mounted to the printer main unit by the tray.
Figure 22B:
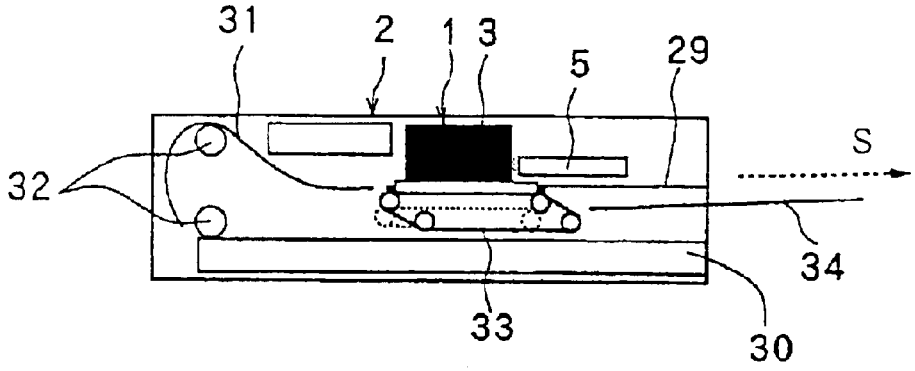

In FIGS. 22A and 22B, reference numeral 30 denotes a recording sheet tray, 31 denotes a recording sheet, 32 denotes a transporting roller, 33 denotes a transporting belt, 34 denotes a discharge tray, and S indicates the direction in which the recording sheets are discharged.

As shown in FIG. 22A, an ink jet head 1 wherein a head cap 5 is integrally mounted to the an ink cartridge 3 is loaded in the direction indicated by the arrow Q on a predetermined position of a tray 29 which is arranged to travel inwards into and outwards from the printer main unit 2. The tray 29 is used for setting the ink jet head 1 within the printer main unit 2 or exchanging ink jet heads. Subsequently, the tray 29 is moved in the direction indicated by the arrow R so as to be set within the printer main unit 2. At this time, the head cap 5 is retained by suitable retaining means provided within the printer main unit 2 while moving in the direction indicated by the arrow R and stops, as shown in FIG. 22B.

Subsequently, moving the tray 29 in the direction indicated by the arrow R causes the ink cartridge 3 to be move relative to the head cap 5 direction indicated by the arrow R, and consequently, the head cap 5 opens. At the same time, the ink discharge face 6 of the print head 4 is cleaned by the operations shown in FIGS. 11A through 11H, and preliminary discharge of ink is performed when the ink cartridge 3 moves relative to the head cap 5 direction indicated by the arrow R. Following this, characters and images are printed on the recording sheets.

Now, each time a predetermined number of sheets are printed following starting printing operations, the printing operations are temporarily interrupted, and at this time, the ink cartridge 3 is moved in the direction opposite to arrow R relative to the head cap 5 so as to temporarily close the head cap 5, following which the ink cartridge 3 moves in the direction of the arrow R relative to the head cap 5 so as to temporarily reopen the head cap 5.

At this time, cleaning of the ink discharge face 6 and preliminary discharge is performed in conjunction with the relative opening action of the head cap 5. Upon completion of cleaning of the ink discharge face 6 and preliminary discharge, the printing operations resume.

Upon completion of the printing operations, the ink cartridge 3 is moved in the direction opposite to arrow R relative to the head cap 5, so as to assume the initial state wherein the head cap 5 is closed. With the present embodiment, when the ink cartridge 3 returns in the direction to close the head cap 5, neither cleaning of the ink discharge face 6 of the print head 4 nor preliminary discharge of ink is performed. However, arrangements may be made wherein cleaning of the ink discharge face 6 of the print head 4 and preliminary discharge of ink is performed when the ink cartridge 3 returns in the direction to close the head cap 5, or wherein just one or the other of cleaning of the ink discharge face 6 of the print head 4 and preliminary discharge of ink is performed. Moreover, the cleaning and preliminary discharge may be performed each time a predetermined amount of time elapses instead of each time a predetermined number of sheets being printed following starting printing operations.

While the present invention has been described so far with reference to an example of a line-head ink jet printer as an image formation apparatus, the present invention is by no means restricted to line-head ink jet printers; rather, the present invention may be applied to serial ink jet printers as well, and further, to a wide range of image formation apparatus such as facsimile apparatuses and photocopiers using the ink jet method for the recording method thereof.

What is claimed is:

1. An image formation apparatus having a print head with an ink discharge face where ink discharge orifices are provided, whereby ink is discharged from said ink discharge orifices so as to form an image on a recording medium, said image formation apparatus comprising:

a cleaning member cylindrically formed of a material having elasticity;

moving means for effecting relative motion between a peripheral face of said cleaning member and the ink discharge face of said print head, with both in contact one with another; and driving control means for controlling the driving of said moving means;

wherein, each time a predetermined number of sheets of said recording medium have images formed thereupon following starting of operations for forming images, the image formation operations are temporarily interrupted, and said moving means are driven under the control of said driving control means, and the peripheral face of said cleaning member is moved over the surface of said ink discharge face while in contact therewith, thereby suctioning the ink within said ink discharge orifices.

2. An image formation apparatus according to claim 1, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face while in contact therewith in conjunction with the opening action of said cap member, and wherein said cap member is temporarily closed and then opened again during interruption of said image formation operations.

3. An image formation apparatus according to claim 1, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face while in contact therewith in conjunction with the closing action of said cap member, and wherein said cap member is temporarily closed and then opened again during interruption of said image formation operations.

4. An image formation apparatus having a print head with an ink discharge face where ink discharge orifices are provided, whereby ink is discharged from said ink discharge orifices so as to form an image on a recording medium, said image formation apparatus comprising:

a cleaning member cylindrically formed of a material having elasticity;

moving means for effecting relative motion between a peripheral face of said cleaning member and the ink discharge face of said print head, with both in contact one with another; driving control means for controlling the driving of said moving means; and discharge control means for controlling discharge operations of ink from ink discharge orifices on said ink discharge face;

wherein, each time a predetermined number of sheets of said recording medium have images formed thereupon following starting of operations for forming images, the image formation operations are temporarily interrupted, and said moving means are driven under the control of said driving control means, and the peripheral face of said cleaning member is moved over the surface of said ink discharge face while in contact therewith, thereby suctioning the ink within said ink discharge orifices, and further wherein, following said cleaning member moving over said ink discharge face, under control of said discharge control means, preliminary discharge of ink from said ink discharge orifices is performed.

5. An image formation apparatus according to claim 4, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face while in contact therewith in conjunction with the opening action of said cap member, and wherein said cap member is temporarily closed and then opened again during interruption of said image formation operations.

6. An image formation apparatus according to claim 4, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face while in contact therewith in conjunction with the closing action of said cap member, and wherein said cap member is temporarily closed and then opened again during interruption of said image formation operations.

7. An image formation apparatus having a print head with an ink discharge face where ink discharge orifices are provided, whereby ink is discharged from said ink discharge orifices so as to form an image on a recording medium, said image formation apparatus comprising:

a cleaning member cylindrically formed of a material having elasticity;

moving means for effecting relative motion between a peripheral face of said cleaning member and the ink discharge face of said print head, with both in contact one with another;

driving control means for controlling the driving of said moving means; and discharge control means for controlling discharge operations of ink from ink discharge orifices on said ink discharge face;

wherein, each time a predetermined number of sheets of said recording medium have images formed thereupon following starting of operations for forming images, the image formation operations are temporarily interrupted, and discharge operations of ink from ink discharge orifices are performed under control of said discharge control means, whereby preliminary discharge of ink from said ink discharge orifices is performed.

8. An image formation apparatus according to claim 7, further comprising a cap member for storing said cleaning member therein and also protecting said ink discharge face of said print head, wherein opening and closing of said cap member is performed by driving said moving means such that relative motion is effected between said cleaning member and said print head in conjunction with the opening action of said cap member, and wherein said cap member is temporarily closed and then opened again during interruption of said image formation operations.

9. An image formation apparatus according to claim 7, further comprising a cap member for storing said cleaning member therein and also protecting said ink discharge face of said print head, wherein opening and closing of said cap member is performed by driving said moving means such that relative motion is effected between said cleaning member and said print head in conjunction with the closing action of said cap member, and wherein said cap member is temporarily closed and then opened again during interruption of said image formation operations.

10. An image formation apparatus having a print head with an ink discharge face where rows of ink discharge orifices for each of a plurality of colors are provided, whereby ink is discharged from said ink discharge orifices so as to form an image on a recording medium, said image formation apparatus comprising:

a cleaning member cylindrically formed of a material having elasticity;

a cap member for storing said cleaning member therein and also protecting said ink discharge face of said print head;

cap opening/closing means for opening and closing said cap member, so that relative motion is effected between a peripheral face of said cleaning member and the ink discharge face of said print head in a direction orthogonal to the rows of ink discharge orifices for each color, with both in contact one with another, in conjunction with the opening action of said cap member;

driving control means for controlling the driving of said cap opening/closing means; and discharge control means for controlling discharge operations of ink from ink discharge orifices on said ink discharge face;

wherein, each time a predetermined number of sheets of said recording medium have images formed thereupon following starting of operations for forming images, the image formation operations are temporarily interrupted, and said cap opening/closing means are driven under the control of said driving control means to temporarily close said cap member and then reopen, and the peripheral face of said cleaning member is moved over the surface of said ink discharge face while in contact therewith, thereby suctioning the ink within said ink discharge orifices, and further wherein, following said cleaning member moving over said ink discharge face, under control of said discharge control means, preliminary discharge of ink from said ink discharge orifices is performed in the order of the rows of ink discharge orifices of each color on said ink discharge face which said cleaning member has passed over.

11. An image formation apparatus having a print head with an ink discharge face where rows of ink discharge orifices for each of a plurality of colors are provided, whereby ink is discharged from said ink discharge orifices so as to form an image on a recording medium, said image formation apparatus comprising:

a cleaning member cylindrically formed of a material having elasticity;

a cap member for storing said cleaning member therein and also protecting said ink discharge face of said print head;

cap opening/closing means for opening and closing said cap member, so that relative motion is effected between a peripheral face of said cleaning member and the ink discharge face of said print head in a direction orthogonal to the rows of ink discharge orifices for each color, with both in contact one with another, in conjunction with the closing action of said cap member;

driving control means for controlling the driving of said cap opening/closing means; and discharge control means for controlling discharge operations of ink from ink discharge orifices on said ink discharge face;

wherein, each time a predetermined number of sheets of said recording medium have images formed thereupon following starring of operations for forming images, the image formation operations are temporarily interrupted, and said cap opening/closing means are driven under the control of said driving control means to temporarily close said cap member and then reopen, and the peripheral face of said cleaning member is moved over the surface of said ink discharge face while in contact therewith, thereby suctioning the ink within said ink discharge orifices, and further wherein, following said cleaning member moving over said ink discharge face, under control of said discharge control means, preliminary discharge of ink from said ink discharge orifices is performed in the order of the rows of ink discharge orifices of each color on said ink discharge face which said cleaning member has passed over.

12. An image formation apparatus having a print head with an ink discharge face where ink discharge orifices are provided, whereby ink is discharged from said ink discharge orifices so as to form an image on a recording medium, said image formation apparatus comprising:

a cleaning member cylindrically formed of a material having elasticity;

moving means for effecting relative motion between a peripheral face of said cleaning member and the ink discharge face of said print head, with both in contact one with another; and driving control means for controlling the driving of said moving means;

wherein, each time a predetermined amount of time elapses following starting of operations for forming images on said recording medium, the image formation operations are temporarily interrupted, and said moving means are driven under the control of said driving control means, and the peripheral face of said cleaning member is moved over the surface of said ink discharge face while in contact therewith, thereby suctioning the ink within said ink discharge orifices.

13. An image formation apparatus according to claim 12, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face of said print head while in contact therewith in conjunction with the opening action of said cap member, and wherein said cap member is temporarily closed and then opened again during interruption of said image formation operations.

14. An image formation apparatus according to claim 12, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face of said print head while in contact therewith in conjunction with the closing action of said cap member, and wherein said cap member is temporarily closed and then opened again during interruption of said image formation operations.

15. An image formation apparatus having a print head with an ink discharge face where ink discharge orifices are provided, whereby ink is discharged from said ink discharge orifices so as to form an image on a recording medium, said image formation apparatus comprising:

a cleaning member cylindrically formed of a material having elasticity;

moving means for effecting relative motion between a peripheral face of said cleaning member and the ink discharge face of said print head, with both in contact one with another;

driving control means for controlling the driving of said moving means; and discharge control means for controlling discharge operations of ink from ink discharge orifices on said ink discharge face;

wherein, each time a predetermined amount of time elapses following starting of operations for forming images on said recording medium, the image formation operations are temporarily interrupted, and said moving means are driven under the control of said driving control means, and the peripheral face of said cleaning member is moved over the surface of said ink discharge face while in contact therewith, thereby suctioning the ink within said ink discharge orifices, and further wherein, following said cleaning member moving over said ink discharge face, under control of said discharge control means, preliminary discharge of ink from said ink discharge orifices is performed.

16. An image formation apparatus according to claim 15, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face while in contact therewith in conjunction with the opening action of said cap member, and wherein said cap member is temporarily closed and then opened again during interruption of said image formation operations.

17. An image formation apparatus according to claim 15, further comprising a cap member for storing said cleaning member therein and also protecting said ink discharge face of said print head, wherein opening and closing of said cap member is performed by driving said moving means such that the peripheral face of said cleaning member is relatively moved over the surface of said ink discharge face while in contact therewith in conjunction with the closing action of said cap member, and wherein said cap member is temporarily closed and then opened again during interruption of said image formation operations.

18. An image formation apparatus having a print head with an ink discharge face where ink discharge orifices are provided, whereby ink is discharged from said ink discharge orifices so as to form an image on a recording medium, said image formation apparatus comprising:

a cleaning member cylindrically formed of a material having elasticity;

moving means for effecting relative motion between a peripheral face of said cleaning member and the ink discharge face of said print head, with both in contact one with another;

driving control means for controlling the driving of said moving means; and discharge control means for controlling discharge operations of ink from ink discharge orifices on said ink discharge face;

wherein, each time a predetermined amount of time elapses following starting of operations for forming images on said recording medium, the image formation operations are temporarily interrupted, and discharge operations of ink from ink discharge orifices are performed under control of said discharge control means, whereby preliminary discharge of ink from said ink discharge orifices is performed.

19. An image formation apparatus according to claim 18, further comprising a cap member for storing said cleaning member therein and also protecting said ink discharge face of said print head, wherein opening and closing of said cap member is performed by driving said moving means such that relative motion is effected between said cleaning member and said print head in conjunction with the opening action of said cap member, and wherein said cap member is temporarily closed and then opened again during interruption of said image formation operations.

20. An image formation apparatus according to claim 18, further comprising a cap member for storing said cleaning member therein and also protecting said ink discharge face of said print head, wherein opening and closing of said cap member is performed by driving said moving means such that relative motion is effected between said cleaning member and said print head in conjunction with the closing action of said cap member, and wherein said cap member is temporarily closed and then opened again during interruption of said image formation operations.

21. An image formation apparatus having a print head with an ink discharge face where rows of ink discharge orifices for each of a plurality of colors are provided, whereby ink is discharged from said ink discharge orifices so as to form an image on a recording medium, said image formation apparatus comprising:

a cleaning member cylindrically formed of a material having elasticity;

a cap member for storing said cleaning member therein and also protecting said ink discharge face of said print head;

cap opening/closing means for opening and closing said cap member, so that relative motion is effected between a peripheral face of said cleaning member and the ink discharge face of said print head in a direction orthogonal to the rows of ink discharge orifices for each color, with both in contact one with another, in conjunction with the opening action of said cap member;

driving control means for controlling the driving of said cap opening/closing means; and discharge control means for controlling discharge operations of ink from ink discharge orifices on said ink discharge face;

wherein, each time a predetermined amount of time elapses following starting of operations for forming images, the image formation operations are temporarily interrupted, and said cap opening/closing means are driven under the control of said driving control means to temporarily close said cap member and then reopen, and the peripheral face of said cleaning member is moved over the surface of said ink discharge face while in contact therewith, thereby suctioning the ink within said ink discharge orifices, and further wherein, following said cleaning member moving over said ink discharge face, under control of said discharge control means, preliminary discharge of ink from said ink discharge orifices is performed in the order of the rows of ink discharge orifices of each color on said ink discharge face which said cleaning member has passed over.

22. An image formation apparatus having a print head with an ink discharge face where rows of ink discharge orifices for each of a plurality of colors are provided, whereby ink is discharged from said ink discharge orifices so as to form an image on a recording medium, said image formation apparatus comprising:

a cleaning member cylindrically formed of a material having elasticity;

a cap member for storing said cleaning member therein and also protecting said ink discharge face of said print head;

cap opening/closing means for opening and closing said cap member, so that relative motion is affected between a peripheral face of said cleaning member and the ink discharge face of said print head in a direction orthogonal to the rows of ink discharge orifices for each color, with both in contact one with another, in conjunction with the closing action of said cap member;

driving control means for controlling the driving of said cap opening/closing means; and discharge control means for controlling discharge operations of ink from ink discharge orifices on said ink discharge face;

wherein, each time a predetermined amount of time elapses following starting of operations for forming images on said recording medium, the image formation operations are temporarily interrupted, and said cap opening/closing means are driven under the control of said driving control means to temporarily close said cap member and then reopen, and the peripheral face of said cleaning member is moved over the surface of said ink discharge face while in contact therewith, thereby suctioning the ink within said ink discharge orifices, and further wherein, following said cleaning member moving over said ink discharge face, under control of said discharge control means, preliminary discharge of ink from said ink discharge orifices is performed in the order of the rows of ink discharge orifices of each color on said ink discharge face which said cleaning member has passed over.

23. An image formation apparatus according to any of claims 1 through 22, wherein said cap member is closed following said image formation operations.

24. An image formation apparatus according to any of claims 5, 6, 8, 9, 10, 11, 16, 17, 19, 20, 21, and 22, wherein an ink receptacle, for receiving ink discharged from said ink discharge orifices by preliminary discharging, is provided on the inner side of said cap member.

25. A control method for an image formation apparatus comprising a print head having an ink discharge face where ink discharge orifices are provided, a cleaning member cylindrically formed of a material having elasticity, moving means for effecting relative motion between a peripheral face of said cleaning member and the ink discharge face of said print head, with both in contact one with another, and driving control means for controlling the driving of said moving means, whereby ink is discharged from said ink discharge orifices so as to form an image on a recording medium, the control method comprising the steps of, each time a predetermined number of sheets of said recording medium have images formed thereupon following starting of operations for forming images, temporarily interrupting the image formation operations, driving said moving means under the control of said driving control means, and moving the peripheral face of said cleaning member over the surface of said ink discharge face while in contact therewith, thereby suctioning the ink within said ink discharge orifices.

26. A control method for an image formation apparatus according to claim 25, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face while in contact therewith in conjunction with the opening action of said cap member, wherein said cap member is temporarily closed and then opened again during interruption of said image formation operations.

27. A control method for an image formation apparatus according to claim 25, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face while in contact therewith in conjunction with the closing action of said cap member, and wherein said cap member is temporarily closed and then opened again during interruption of said image formation operations.

28. A control method for an image formation apparatus comprising a print head having an ink discharge face where ink discharge orifices are provided, a cleaning member cylindrically formed of a material having elasticity, moving means for effecting relative motion between a peripheral face of said cleaning member and the ink discharge face of said print head, with both in contact one with another, driving control means for controlling the driving of said moving means, and discharge control means for controlling discharge operations of ink from ink discharge orifices on said ink discharge face, whereby ink is discharged from said ink discharge orifices so as to form an image on a recording medium, the control method comprising the steps of, each time a predetermined number of sheets of said recording medium have images formed thereupon following starting of operations for forming images, temporarily interrupting the image formation operations driving said moving means under the control of said driving control means, and moving the peripheral face of said cleaning member over the surface of said ink discharge face while in contact therewith, thereby suctioning the ink within said ink discharge orifices, and further wherein, following moving said cleaning member over said ink discharge face, under control of said discharge control means, performing preliminary discharge of ink from said ink discharge orifices.

29. A control method for an image formation apparatus according to claim 28, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face of said print head while in contact therewith in conjunction with the opening action of said cap member, wherein said cap member is temporarily closed and then opened again during interruption of said image formation operations.

30. A control method for an image formation apparatus according to claim 28, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face of said print head while in contact therewith in conjunction with the closing action of said cap member, wherein said cap member is temporarily closed and then opened again during interruption of said image formation operations.

31. A control method for an image formation apparatus comprising a print head having an ink discharge face when ink discharge orifices are provided, a cleaning member cylindrically formed of a material having elasticity, moving means for effecting relative motion between a peripheral face of said cleaning member and the ink discharge face of said print head, with both in contact one with another, driving control means for controlling the driving of said moving means, and discharge control means for controlling discharge operations of ink from ink discharge orifices on said ink discharge face, whereby ink is discharged from said ink discharge orifices so as to form an image on a recording medium, the control method comprising the steps of, each time a predetermined number of sheets of said recording medium have images formed thereupon following starting of operations for forming images, temporarily interrupting the image formation operations, performing said discharge operations of ink from ink discharge orifices under control of said discharge control means, and effecting control to perform preliminary discharge of ink from said ink discharge orifices.

32. A control method for an image formation apparatus according to claim 31, further comprising a cap member for storing said cleaning member therein and also protecting said ink discharge face of said print head, said method further comprising performing opening and closing of said cap member by driving said moving means such that relative motion is effected between said cleaning member and said print head in conjunction with the opening action of said cap member, wherein said cap member is temporarily closed and then opened again during interruption of said image formation operations.

33. A control method for an image formation apparatus according to claim 31, further comprising a cap member for storing said cleaning member therein and also protecting said ink discharge face of said print head, said method further comprising performing opening and closing of said cap member by driving said moving means such that relative motion is effected between said cleaning member and said print head in conjunction with the closing action of said cap member, and wherein said cap member is temporarily closed and then opened again during interruption of said image formation operations.

34. A control method for an image formation apparatus comprising a print head with an ink discharge face where rows of ink discharge orifices for each of a plurality of colors are provided, a cleaning member cylindrically formed of a material having elasticity, a cap member for storing said cleaning member therein and also protecting said ink discharge face of said print head, cap opening/closing means for opening and closing said cap member, so that relative motion is effected between a peripheral face of said cleaning member and the ink discharge face of said print head in a direction orthogonal to the rows of ink discharge orifices for each color, with both in contact one with another, in conjunction with the opening action of said cap member, driving control means for controlling the driving of said cap opening/closing means, and discharge control means for controlling discharge operations of ink from ink discharge orifices on said ink discharge face, whereby ink is discharged from said ink discharge orifices so as to form an image on a recording medium, the control method comprising the steps of, each time a predetermined number of sheets of said recording medium have images formed thereupon following starting of operations for forming images, temporarily interrupting the image formation operations, driving said cap opening/closing means under the control of said driving control means to temporarily close said cap member and then reopen, and moving the peripheral face of said cleaning member over the surface of said ink discharge face while in contact therewith, thereby suctioning the ink within said ink discharge orifices, and further wherein, following moving said cleaning member over said ink discharge face, under control of said discharge control means, performing preliminary discharge of ink from said ink discharge orifices in thee order of the rows of ink discharge orifices of each color on said ink discharge face which said cleaning member has passed over.

35. A control method for an image formation apparatus comprising a print head with an ink discharge face where rows of ink discharge orifices for each of a plurality of colors are provided, a cleaning member cylindrically formed of a material having elasticity, a cap member for storing said cleaning member therein and also protecting said ink discharge face of said print head, cap opening/closing means for opening and closing said cap member, so that relative motion is effected between a peripheral face of said cleaning member end the ink discharge face of said print head in a direction orthogonal to the rows of ink discharge orifices for each color, with both in contact one with another, in conjunction with the closing action of said cap member, driving control means for controlling the driving of said cap opening/closing means, and discharge control means for controlling discharge operations of ink from ink discharge orifices on said ink discharge face, whereby ink is discharged from said ink discharge orifices so as to form an image on a recording medium, the control method comprising the steps of, each time a predetermined number of sheets of said recording medium have images formed thereupon following starting of the operations for forming images, temporarily interrupting the image formation operations, driving said cap opening/closing means under the control of said driving control means to temporarily close said cap member and then reopen, and moving the peripheral face of said cleaning member over the surface of said ink discharge face while in contact therewith, thereby suctioning the ink within said ink discharge orifices, and further wherein, following moving said cleaning member over said ink discharge face, under control of said discharge control means, performing preliminary discharge of ink from said ink discharge orifices in the order of the rows of ink discharge orifices of each color on said ink discharge face which said cleaning member has passed over.

36. A control method for an image formation apparatus comprising a print head having an ink discharge face where ink discharge orifices are provided, a cleaning member cylindrically formed of a material having elasticity, moving means for effecting relative motion between a peripheral face of said cleaning member and the ink discharge face of said print head, with both in contact one with another, and driving control means for controlling the driving of said moving means, whereby ink is discharged from said ink discharge orifices so as to form an image on a recording medium, the control method comprising the steps of, each time a predetermined amount of time elapses following starting of the operations for forming images on said recording medium, temporarily interrupting the image formation operations, driving said moving means under the control of said driving control means, and moving the peripheral face of said cleaning member over the surface of said ink discharge face while an contact therewith, thereby suctioning the ink within said ink discharge orifices.

37. A control method for an image formation apparatus according to claim 36, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face of said print head while in contact therewith in conjunction with the opening action of said cap member, and wherein said cap member is temporarily closed and then opened again during interruption of said image formation operations.

38. A control method for an image formation apparatus according to claim 36, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face of said print head while in contact therewith in conjunction with the closing action of said cap member, wherein said cap member is temporarily closed and then opened again during interruption of said image formation operations.

39. A control method for an image formation apparatus comprising a print head with an ink discharge face where ink discharge orifices are provided, a cleaning member cylindrically formed of a material having elasticity, moving means for effecting relative motion between a peripheral face of said cleaning member and the ink discharge face of said print head, with both in contact one with another, driving control means for controlling the driving of said moving means, and discharge control means for controlling discharge operations of ink from ink discharge orifices on said ink discharge face, whereby ink is discharged from said ink discharge orifices so as to form an image on a recording medium;

the control method comprising the steps of, each time a predetermined amount of time elapses following starting of operations for forming images on said recording medium, temporarily interrupting the image formation operations, driving said moving means under the control of said driving control means, and moving the peripheral face of said cleaning member over the surface of said ink discharge face while in contact therewith, thereby suctioning the ink within said ink discharge orifices, and further wherein, following moving said cleaning member over said ink discharge face, under control of said discharge control means, performing preliminary discharge of ink from said ink discharge orifices.

40. A control method for an image formation apparatus according to claim 39, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face of said print head while in contact therewith in conjunction with the opening action of said cap member, wherein said cap member is temporarily closed and then opened again during interruption of said image formation operations.

41. A control method for an image formation apparatus according to claim 39, further comprising a cap member for storing said cleaning member therein and also protecting said ink discharge face of said print head, said method further comprising performing opening and closing of said cap member by driving said moving means such that the peripheral face of said cleaning member is relatively moved over the surface of said ink discharge face of said print head while in contact therewith in conjunction with the closing action of said cap member, wherein said cap member is temporarily closed and then opened again during interruption of said image formation operations.

42. A control method for an image formation apparatus comprising a print head with an ink discharge face where ink discharge orifices are provided, a cleaning member cylindrically formed of a material having elasticity, moving means for effecting relative motion between a peripheral face of said cleaning member and the ink discharge face of said print head, with both in contact one with another, driving control means for controlling the driving of said moving means, and discharge control means for controlling discharge operations of ink from ink discharge orifices on said ink discharge face, whereby ink is discharged from said ink discharge orifices so as to form an image on a recording medium;

the control method comprising the steps of, each time a predetermined amount of time elapses following starting of operations for forming images on said recording medium, temporarily interrupting the image formation operations, performing discharge operations of ink from ink discharge orifices under control of said discharge control means, whereby preliminary discharge of ink from said ink discharge orifices is performed.

43. A control method for an image formation apparatus according to claim 42, further comprising a cap member for storing said cleaning member therein and also protecting said ink discharge face of said print head, said method further comprising performing opening and closing of said cap member by driving said moving means such that relative motion is effected between said cleaning member and said print head in conjunction with the opening action of said cap member, wherein said cap member is temporarily closed and then opened again during interruption of said image formation operations.

44. A control method for an image formation apparatus according to claim 42, further comprising a cap member for storing said cleaning member therein and also protecting said ink discharge face of said print head, said method further comprising performing opening and closing of said cap member by driving said moving means such that relative motion is effected between said cleaning member and said print head in conjunction with the closing action of said cap member, and wherein said cap member is temporarily closed and then opened again during interruption of said image formation operations.

45. A control method for an image formation apparatus comprising a print head with an ink discharge face where rows of ink discharge orifices for each of a plurality of colors are provided, a cleaning member cylindrically formed of a material having elasticity, a cap member for storing said cleaning member therein and also protecting said ink discharge face of said print head, cap opening/closing means for opening and closing said cap member, so that relative motion is effected between a peripheral face of said cleaning member and the ink discharge face of said print head in a direction orthogonal to the rows of ink discharge orifices for each color, with both in contact one with another, in conjunction with the opening action of said cap member, driving control means for controlling the driving of said cap opening/closing means, and discharge control means for controlling discharge operations of ink from ink discharge orifices on said ink discharge face, whereby ink is discharged from said ink discharge orifices so as to form an image on a recording medium;

the control method comprising the steps of, each time a predetermined amount of time elapses following starting of the operations for forming images, temporarily interrupting the image formation operations, driving said cap opening/closing means under the control of said driving control means to temporarily close said cap member and then reopen, and moving the peripheral face of said cleaning member over the surface of said ink discharge face while in contact therewith, thereby suctioning the ink within said ink discharge orifices, and further wherein, following moving said cleaning member over said ink discharge face, under control of said discharge control means, performing preliminary discharge of ink from said ink discharge orifices in the order of the rows of ink discharge orifices of each color on said ink discharge face which said cleaning member has passed over.

46. A control method for an image formation apparatus comprising a print head with an ink discharge face where rows of ink discharge orifices for each of a plurality of colors are provided, a cleaning member cylindrically formed of a material having elasticity, a cap member for storing said cleaning member therein and also protecting said ink discharge face of said print head, cap opening/closing means for opening and closing said cap member, so that relative motion is effected between a peripheral face of said cleaning member and the ink discharge face of said print head in a direction orthogonal to the rows of ink discharge orifices for each color, with both in contact one with another, in conjunction with the closing action of said cap member, driving control means for controlling the driving of said cap opening/closing means, and discharge control means for controlling discharge operations of ink from ink discharge orifices on said ink discharge face, whereby ink is discharged from said ink discharge orifices so as to form an image on a recording medium;

the control method comprising the steps of, each time a predetermined amount of time elapses following starting of the operations for forming images on said recording medium, temporarily interrupting the image formation operations, driving said cap opening/closing means under the control of said driving control means to temporarily close said cap member and then reopen, and moving the peripheral face of said cleaning member over the surface of said ink discharge face while in contact therewith, thereby suctioning the ink within said ink discharge orifices, and further wherein, following moving said cleaning member over said ink discharge face, under control of said discharge control means, performing preliminary discharge of ink from said ink discharge orifices in the order of the rows of ink discharge orifices of each color on said ink discharge face which said cleaning member has passed over.

47. A control method for an image formation apparatus according to any of claims 25 through 46, said method further comprising performing closing said cap member following said image formation operations.

* * * * *